US006417864B1

(12) United States Patent
Jones et al.

(10) Patent No.: US 6,417,864 B1
(45) Date of Patent: Jul. 9, 2002

(54) LIGHT MODULATING DEVICES

(75) Inventors: John Clifford Jones, Leigh Sinton; Alistair Graham, Powick, both of (GB)

(73) Assignee: The Secretary of State for Defence in Her Brittanic Majesty's Government of the United Kingdom of Great Britain and Northern Ireland Defence Evaluation and Research Agency, Farnborough (GB)

( * ) Notice: Subject to any disclaimer, the term of this patent is extended or adjusted under 35 U.S.C. 154(b) by 0 days.

(21) Appl. No.: 09/301,079

(22) Filed: Apr. 28, 1999

(30) Foreign Application Priority Data

Apr. 29, 1998 (GB) ..... 9809200

(51) Int. Cl.[7] ..... G09G 5/02
(52) U.S. Cl. ..... 345/596; 345/598; 345/599
(58) Field of Search ..... 345/89, 147, 148, 345/149, 88, 153, 596, 598, 599; 347/240; 358/298

(56) References Cited

U.S. PATENT DOCUMENTS

| | | | | |
|---|---|---|---|---|
| 4,921,334 A | | 5/1990 | Akodes | 350/333 |
| 5,068,649 A | * | 11/1991 | Garrett | 345/89 |
| 5,109,282 A | * | 4/1992 | Peli | 358/298 |
| 5,254,982 A | * | 10/1993 | Feigenblatt et al. | 345/148 |
| 5,293,159 A | * | 3/1994 | Bassetti, Jr. et al. | 345/149 |
| 5,455,600 A | * | 10/1995 | Friedman et al. | 345/153 |
| 5,648,796 A | | 7/1997 | Boursier et al. | 345/149 |
| 5,729,276 A | * | 3/1998 | Nelson | 347/240 |
| 5,748,163 A | * | 5/1998 | Han | 345/88 |
| 5,754,309 A | * | 5/1998 | Chen et al. | 358/456 |
| 6,094,187 A | * | 7/2000 | Jones et al. | 345/147 |

FOREIGN PATENT DOCUMENTS

| | | |
|---|---|---|
| EP | 0720139 A2 | 7/1996 |
| EP | 0848369 A2 | 6/1998 |

OTHER PUBLICATIONS

Search Report for GB Application No. 9809200.0; Dated Feb. 5, 1999.

* cited by examiner

*Primary Examiner*—Steven Saras
*Assistant Examiner*—Uchendu O. Anyaso
(74) *Attorney, Agent, or Firm*—Renner, Otto, Boisselle & Sklar

(57) ABSTRACT

When a ferroelectric liquid crystal display (FLCD) panel is addressed in such a manner as to cause adjacent or successive pixels to display different levels of greyscale, the viewer may perceive a pseudo edge effect caused by the perceived error in the transmission level at the transition between the two grey levels. In order to decrease this perceived error, the panel is addressed such that, at the transition between the two grey levels, for example between the grey levels "3" and "4", the most significant bit of the addressing scheme incorporates an analogue grey level, for example a half level. This results in a perception level exhibiting a lower absolute error in the relative grey level than would be obtained if no special measures were taken to compensate for the perceived error at the transition. This compensation technique is applicable to addressing schemes utilizing temporal dither (TD) as well as spatial dither (SD).

33 Claims, 19 Drawing Sheets

| LEVEL | SD 1 | SD 2 | TD 1 | TD 4 | TD 16 |
|---|---|---|---|---|---|
| 0 | 0 | 0 | 0 | 0 | 0 |
| 1 | 1 | 0 | 1 | 0 | 0 |
| 2 | 0 | 1 | 1 | 0 | 0 |
| 3 | 1 | 1 | 1 | 0 | 0 |
| 4 | 1 | 0 | 0 | 1 | 0 |
| 5 | 1 | 0 | 1 | 1 | 0 |
| 6 | 0 | 1 | 1 | 0 | 0 |
| | 1 | 0 | 0 | 1 | 0 |
| ⋮ | | | | | |
| 15 | 1 | 1 | 1 | 1 | 0 |
| 16 | 1 | 0 | 0 | 0 | 1 |
| ⋮ | | | | | |
| 31 | 1 | 0 | 0 | 0 | 1 |
| | 1 | 0 | 0 | 0 | 1 |
| 32 | 0 | 1 | 0 | 0 | 1 |
| ⋮ | | | | | |
Fig. 12
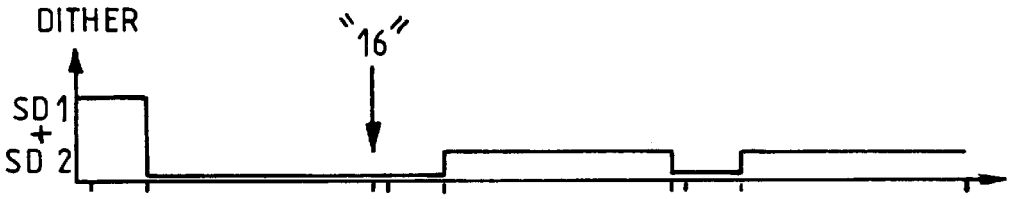
Fig. 13(a)
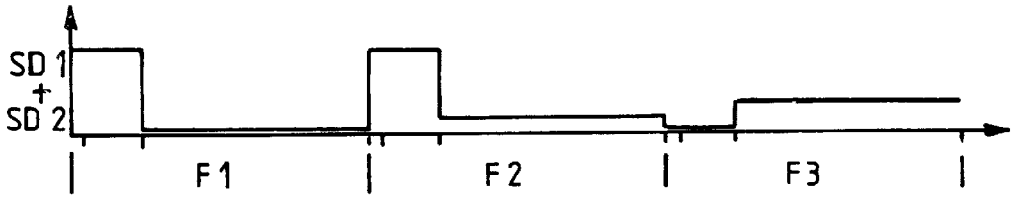
Fig. 13(b)

AG. 24-3-98 definitions - 1

```
Function greystat ( first As grey, second As grey ) As greystat
Dim total As Long
Dim bits As Integer

bits = TD (1, 0) - Number of TD bits
total = 0

startlev = first.level
endlev = startlev
For count1 = 1 To bits
    look = 1
    Do Until TD (2, look) = count1
    Loop
    first.pattern (1, look) = second.pattern (1, look)' copy bit from second gray level to first

    first.pattern (2, look) = second.pattern (2, look)

    endlev = greylevel (first)
    If startlev < endlev Then
        val1 = endlev
        val2 = startlev
    Else:
        val1 = startlev
        val2 = endlev
    End If
    total = total + val1 * (TD(1, look) + 1) + val2 * (TD(1, look) - 1)
    startlev = endlev
Next count1
greystat.ave = total / (2 * (slots - 1))

End Function
```

$$TD\begin{bmatrix}1\\2\end{bmatrix}\begin{matrix}1 & 4 & 16 & 64 \\ 1 & 2 & 3 & 4\end{matrix}\begin{matrix}\leftarrow \text{Bit ratios} \\ \leftarrow \text{bit order}\end{matrix}$$

$$\text{Pattern}\begin{bmatrix}1\\2\end{bmatrix}\begin{matrix}1 & 4 & 16 & 64 \\ \underbrace{2 \quad 8 \quad 33 \quad 128}_{\text{Bit pattern of Desired grey.}}\end{matrix}\begin{matrix}\leftarrow \text{1st SD} \\ \leftarrow \text{2ndSD}\end{matrix}$$

Fig. 20

LIGHT MODULATING DEVICES

This invention relates to light modulating devices, and is concerned more particularly, but not exclusively, with liquid crystal display and optical shutter devices including spatial light modulators.

It should be understood that the term "light modulating devices" is used in this specification to encompass both light transmissive modulators, such as diffractive spatial modulators, and light emissive modulators, such as conventional liquid crystal displays.

Liquid crystal devices are commonly used for displaying alphanumeric information and/or graphic images. Furthermore liquid crystal devices are also used as optical shutters, for example in printers. Such liquid crystal devices comprise a matrix of individually addressable modulating elements which can be designed to produce not only black and white, but also intermediate tones, or colour hue variations in devices in which colour filters are used. The so-called greyscale response of such a device may be produced in a number of ways.

In a spatial dither (SD) technique each modulating element is divided into two or more separately addressable subelements which are addressable by different combinations of switching signals in order to produce different overall levels of grey. For example, in the simple case of an element comprising two equal sized subelements each of which is switchable between a white state and a black state, three grey levels (including white and black) will be obtainable corresponding to both subelements being switched to the white state, both subelements being switched to the black state, and either subelement being in the white state while the other subelement is in the black state. Since both subelements are of the same size, the same grey level will be obtained regardless of which of the subelements is in the white state and which is in the black state, so that the switching circuit must be designed to take account of this level of redundancy. It is also possible for the subelements to be of different sizes which will have the effect that different grey levels will be produced depending on which of the two subelements is in the white state and which is in the black state. However, a limit to the number of subelements which can be provided in practice is imposed by the fact that separate conductive tracks are required for supplying the switching signals to the subelements and the number of such tracks which can be accommodated is limited by space constraints.

In a temporal dither (TD) technique at least part of each modulating element is addressable by different time modulated signals in order to produce different overall levels of grey. For example, in a simple case in which an element is addressable by two subframes of equal duration, the element may be arranged to be in the white state when it is addressed so as to be "on" in both subframes, and the element may be arranged to be in the black state when it is addressed so as to be "off" in both subframes. Furthermore the element may be in an intermediate grey state when it is addressed so as to be "on" in one subframe and "off" in the other subframe. The frame rate should be greater than the frequency at which the dither is observable as flickering. Furthermore it is possible to combine such a temporal dither technique with spatial dither by addressing one or more of the subelements in a spatial dither arrangement by different time modulated signals. This allows an increased range of grey levels to be produced at the cost of increased circuit complexity.

In many applications, and particularly in display devices for displaying moving graphic images, there is a requirement for a large number of suitably spaced grey levels to be generated, with minimum (and preferably no) redundancy of grey levels. Usually the grey levels are linearly spaced as far as possible. To this end the elements may be binary weighted, for example by dividing each element into subelements having surface areas in the ratio 1:2:4 in a SD technique or by addressing of each element with frames having durations in the ratio 1:2:4 in a TD technique. European Patent Publication No. 0261901 A2 discloses a method of maximising the number of grey levels that can be obtained from a certain number of binary temporal divisions of the addressing frame by dividing the addressed rows of the display matrix into groups and addressing the groups sequentially.

Furthermore U.S. Pat. No. 4,712,877 discloses a method of producing discrete grey states within a pixel of a ferroelectric liquid crystal display device by a technique called multi-threshold modulation (MTM), generally by variation of the electric field over the pixel area. For example the liquid crystal thickness may be varied over the pixel area in steps. This method may be combined with dither techniques in order to produce a large number of grey levels, although in practice it is difficult to address more than a few MTM grey states.

There are a number of inherent physical problems encountered in ferroelectric liquid crystal display devices which result in finite errors in the analogue grey states, and which can accordingly result in unpredictable variation of grey levels with time and/or over the display area. Such problems are discussed in P. Maltese, "Advances and problems in the development of ferroelectric liquid crystal displays", Mol. Cryst. Liq. Cryst. 1992, Vol. 215, pp. 57–72, as well as in K-F. Reinhard, "Addressing of ferroelectric liquid crystal matrices and electrooptical characterisation", Ferroelectrics 1991, Vol. 113, pp. 405–417. As is well known, analogue grey states are highly temperature dependent, and the latter reference gives an example in which the display temperature should be uniform to 0.2 degrees if 16 grey levels are required. Both references indicate that the use of thin film transistors for the drive circuitry is advantageous to achieve analogue grey states in such devices.

British Patent Application No. 9603506.8 and Japanese Patent Publications Nos. 27719/1993 and 27720/1993 describe techniques for reducing the error in a 50% analogue grey state to substantially zero by dividing each row (strobe) electrode into two subrows and simultaneously addressing the two subrows such that any local temperature variation has opposite effects in the two subrows tending to cancel the temperature dependence of the grey state for each row. Such a technique allows a substantially error free half (50%) analogue grey state to be obtained. Japanese Patent Application No. 9-72198/1997 describes a technique for obtaining such a substantially error free half state which uses an interlace technique to avoid the need to introduce extra subrows. The term "substantially error free" should be interpreted in this context as meaning that the error associated with such a state is small by comparison with the errors associated with analogue intermediate grey states produced by conventional means.

A digital error occurs when more significant bits of a digital dither arrangement change between successive frames (temporal dither) of adjacent pixels (spatial dither). It is an objective of the present invention to ameliorate this disadvantage.

According to the present invention, there is provided a light modulating device comprising an addressable matrix of modulating elements, and addressing means for selectively addressing each element in order to vary the transmission level of the element relative to the transmission levels of other elements, the addressing means including spatial and/or temporal dither means for addressing separately addressable spatial bits of each element with different combinations of spatial dither signals and/or for addressing at least part of each element with different combinations of temporal dither signals applied to separately addressable temporal bits corresponding to subframes of different periods to produce a plurality of different transmission levels, and state selection means for switching at least a part of each element between different states corresponding to different transmission levels by means of ON and OFF switching signals, wherein the state selection means includes means responsive to at least one transition in grey level between adjacent and/or successive elements which transition involves changing the state of a bit between a first state and a second state for providing at least one intermediate element for which the light transmission level of that bit is intermediate that of the first state and the second state.

Thus at least one problematic transition between grey levels is identified and ameliorated.

While the invention may respond to only one change in grey level, preferably it responds to at least those changes that cause a digital error. Possibly, it responds to all of the possible changes in grey scale.

In a preferred embodiment, the compensating signal is provided by way of an analogue level in the most significant digital bit. This level could be half the transmission level or at some other level. The level may advantageously depend upon whether the most significant bit is changing from dark to light or vice versa.

Further preferred features of the invention will be apparent from the detailed description of preferred embodiments which follows.

In order that the invention may be more fully understood, various addressing schemes for use in light modulating devices in accordance with the invention will now be described, by way of example, with reference to the accompanying drawings, in which.

Figure 8:
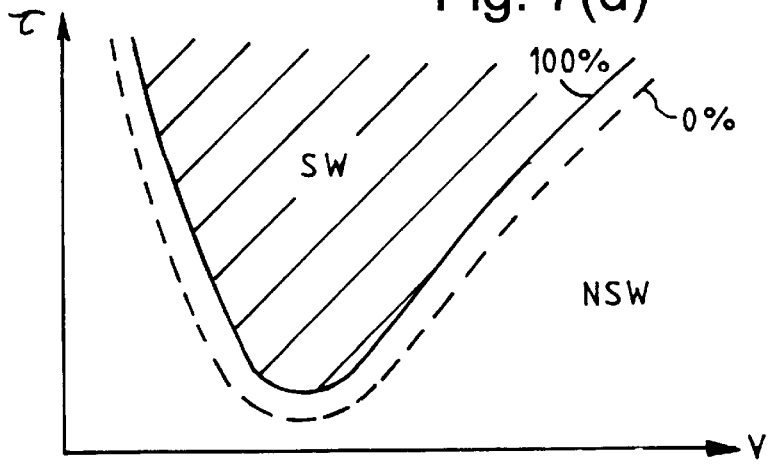
Figure 9:
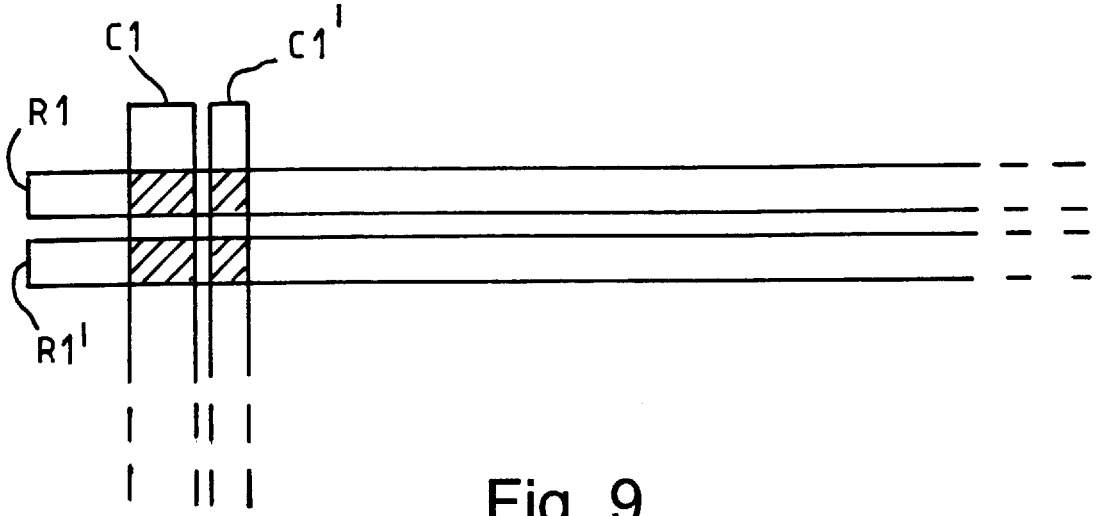
Figure 10A:
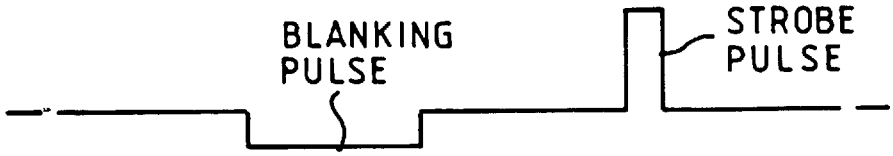
Figure 10B:
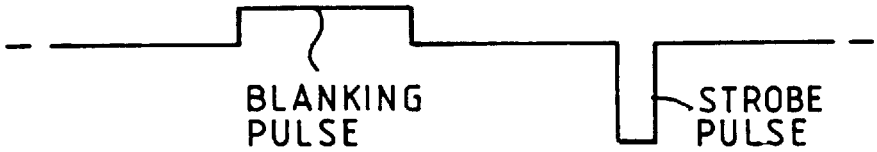
Figure 11A:
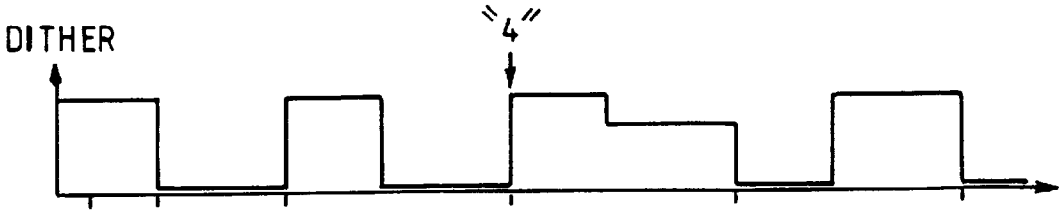
Figure 11B:
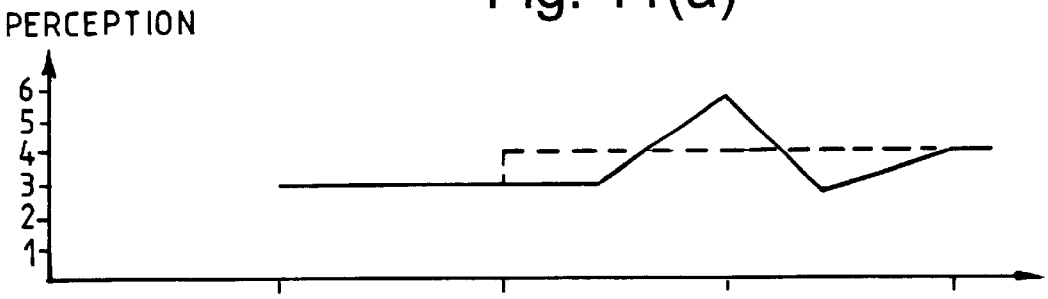
Figure 11C:
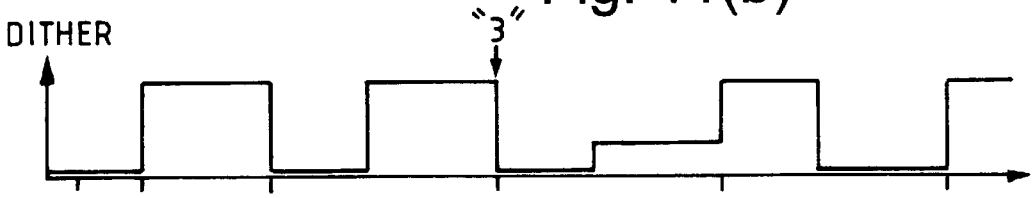
Figure 11D:
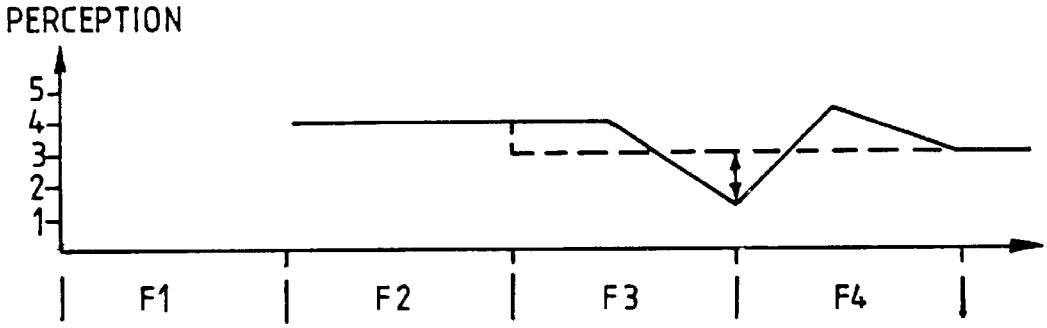
Figure 14:
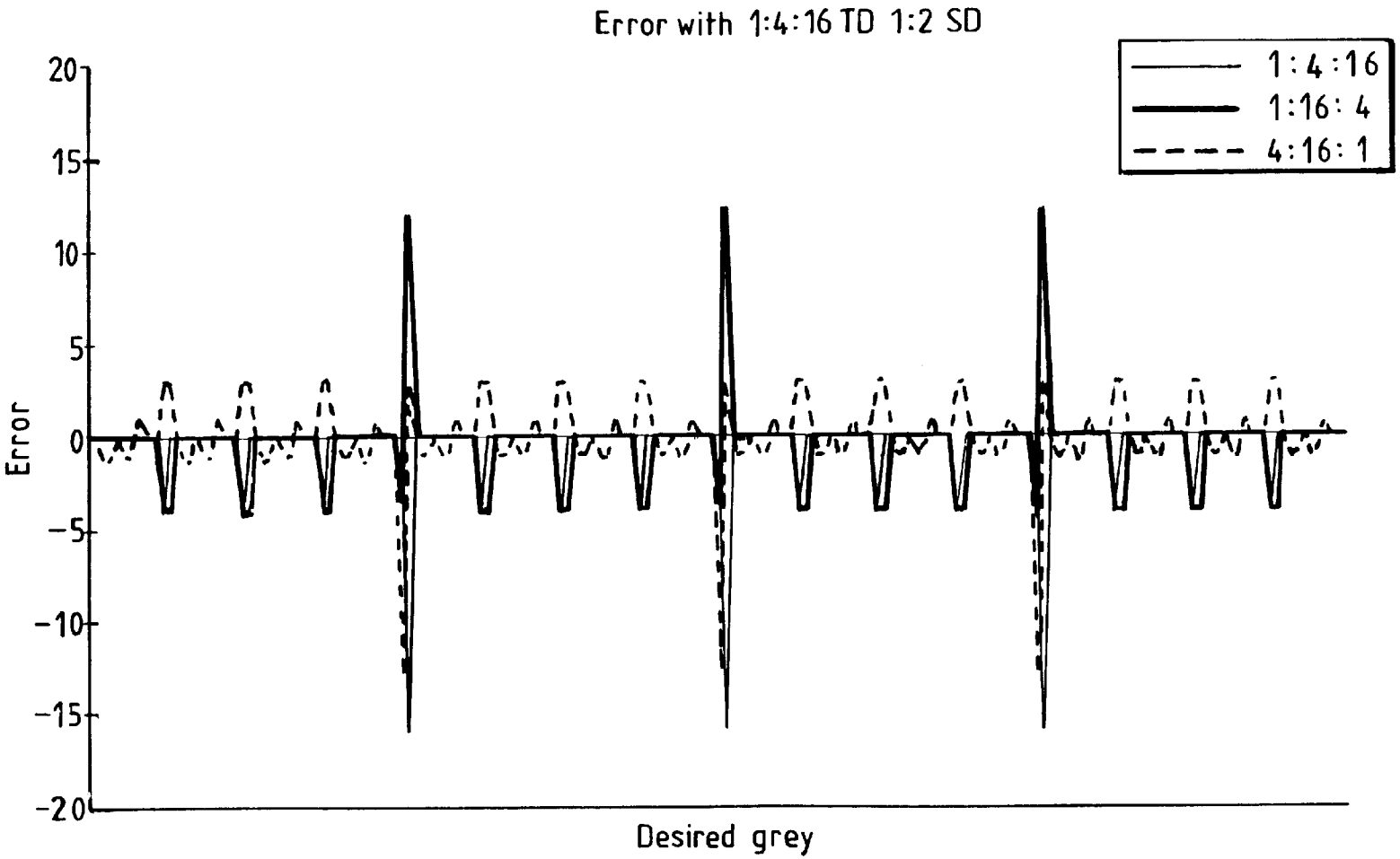
Figure 15:
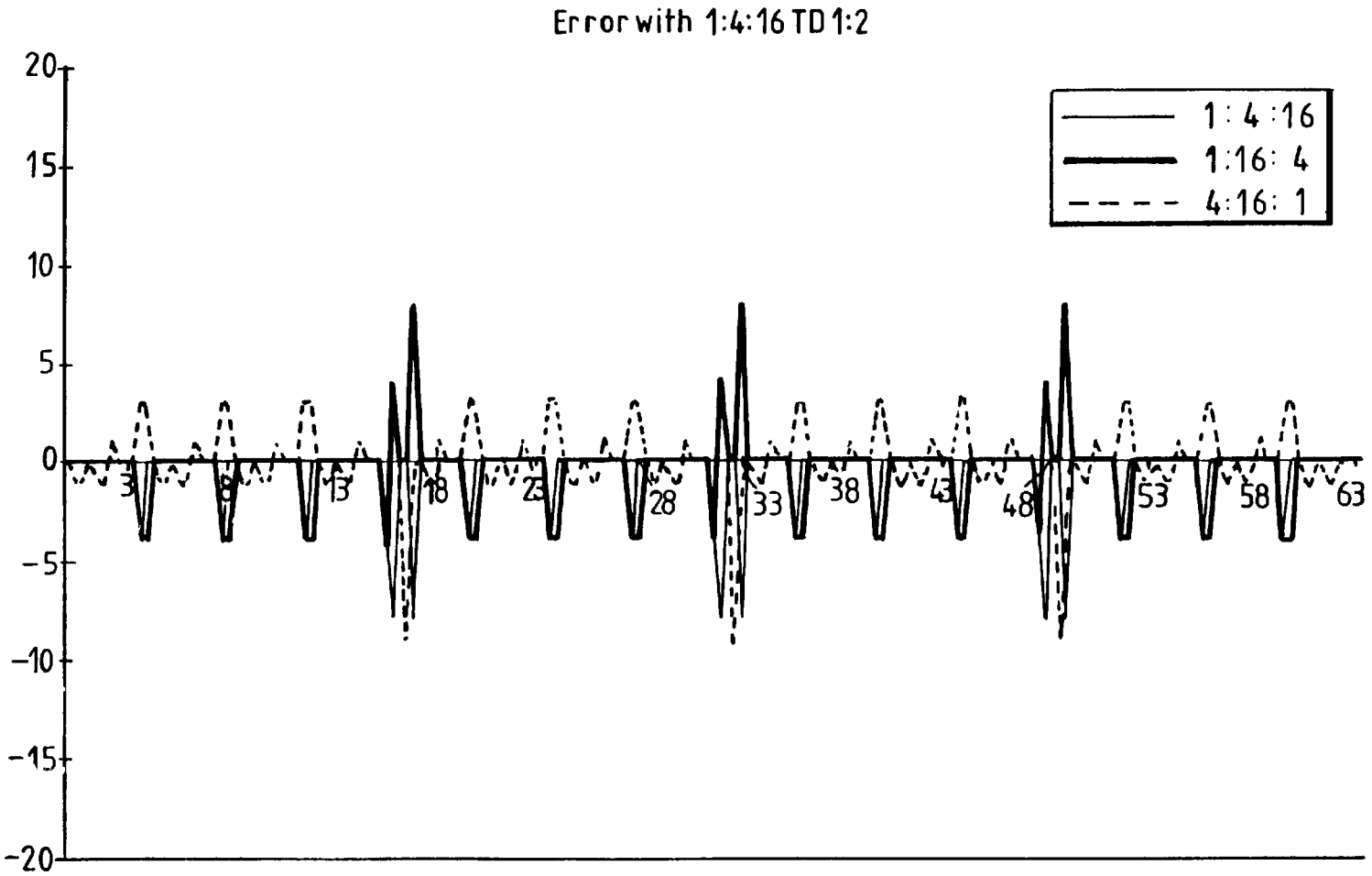
Figure 16A:
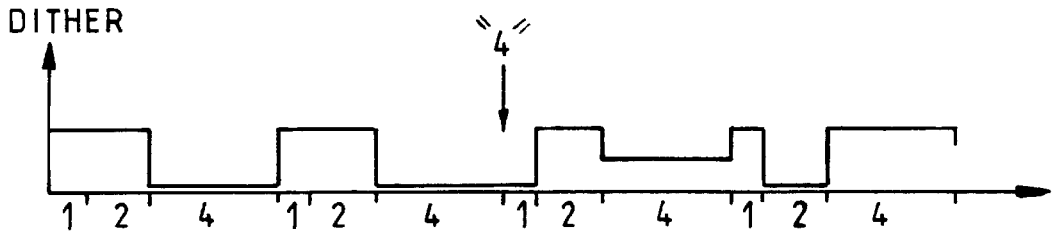
Figure 16B:
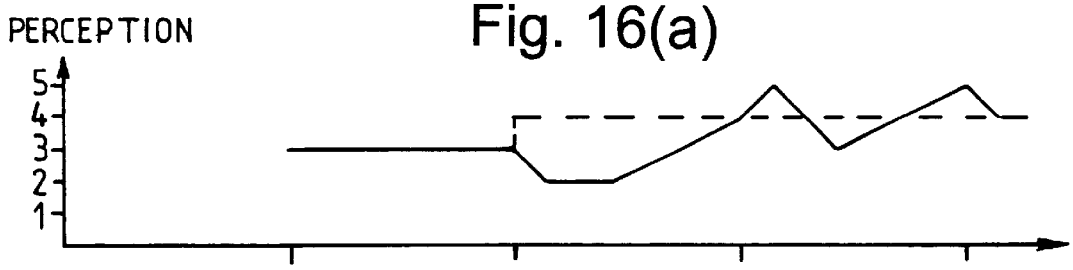
Figure 16C:
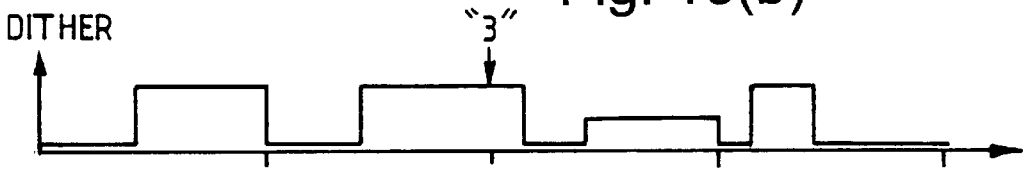
Figure 16D:
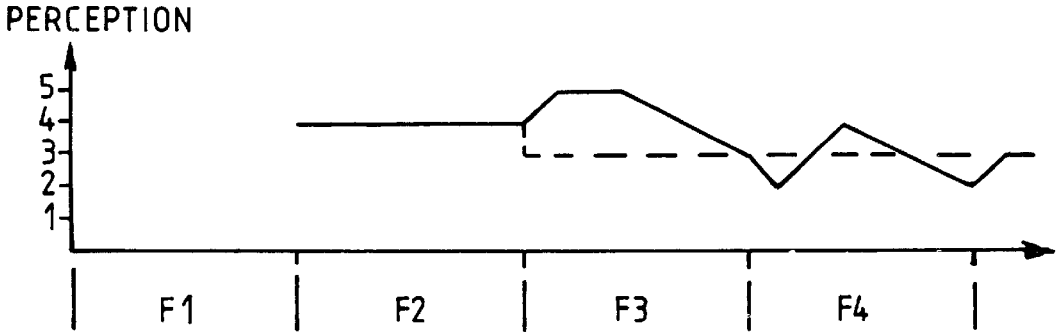
Figure 17:
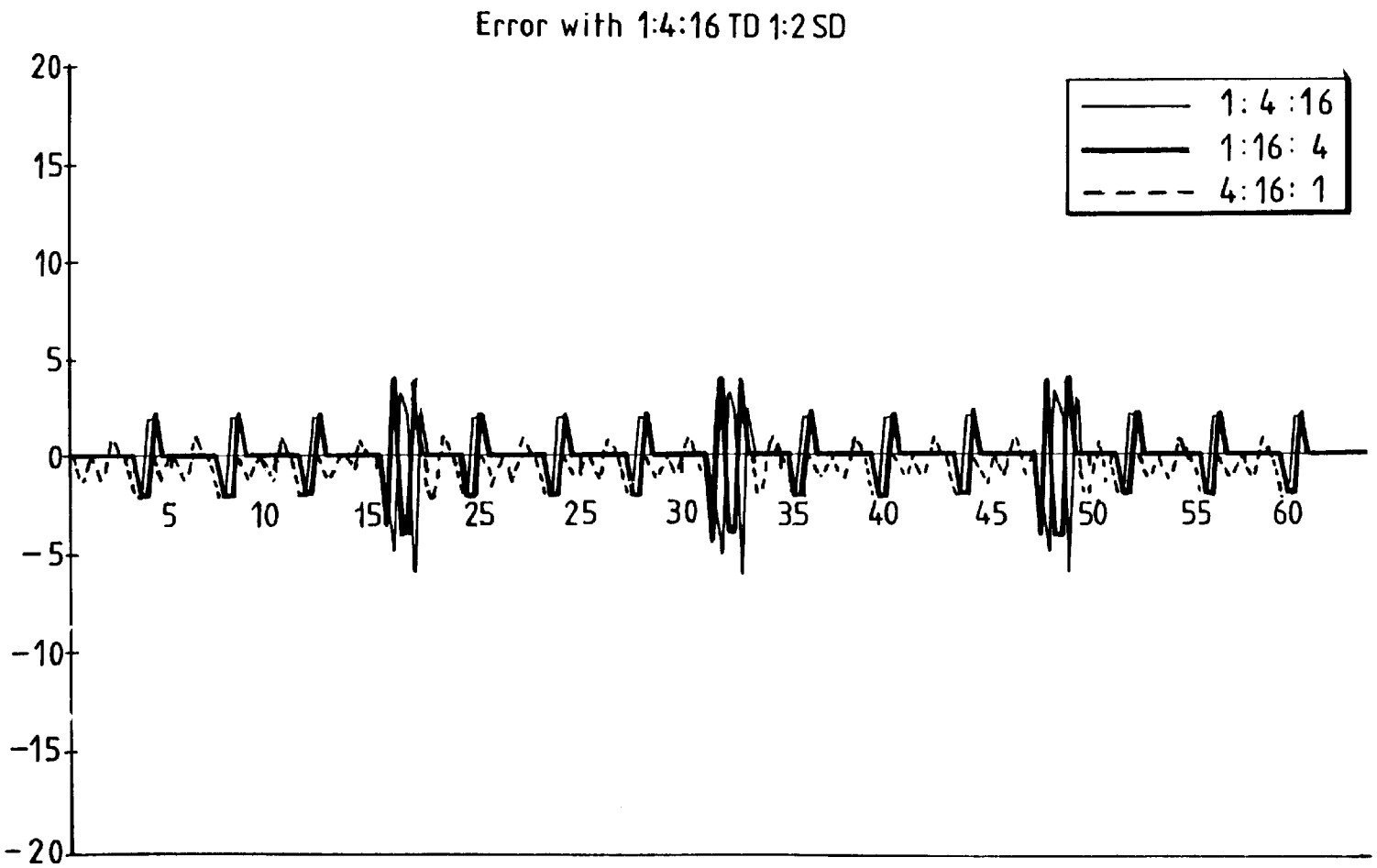
Figure 18A:
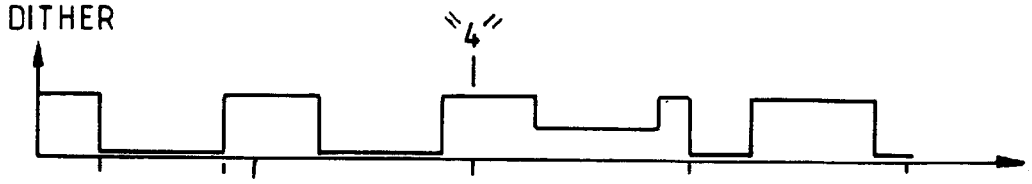
Figure 18B:
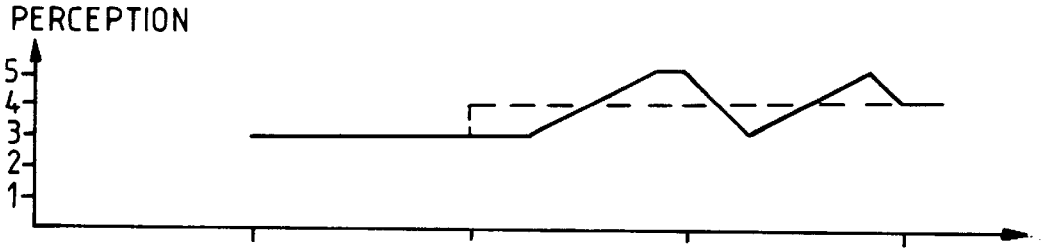
Figure 18C:
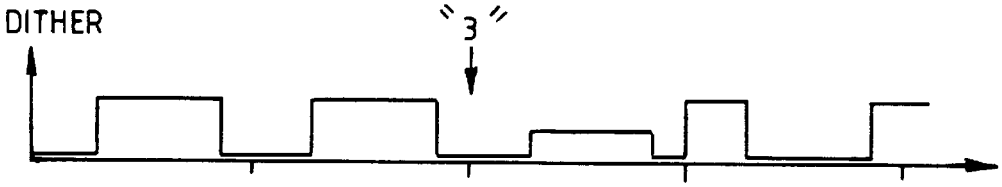
Figure 18D:
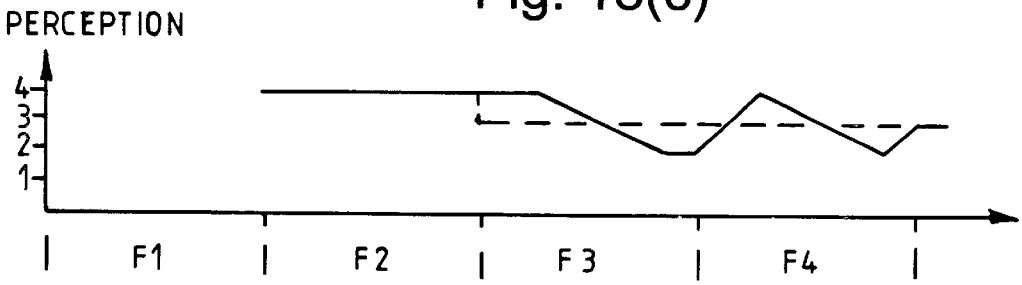
Figure 19A:
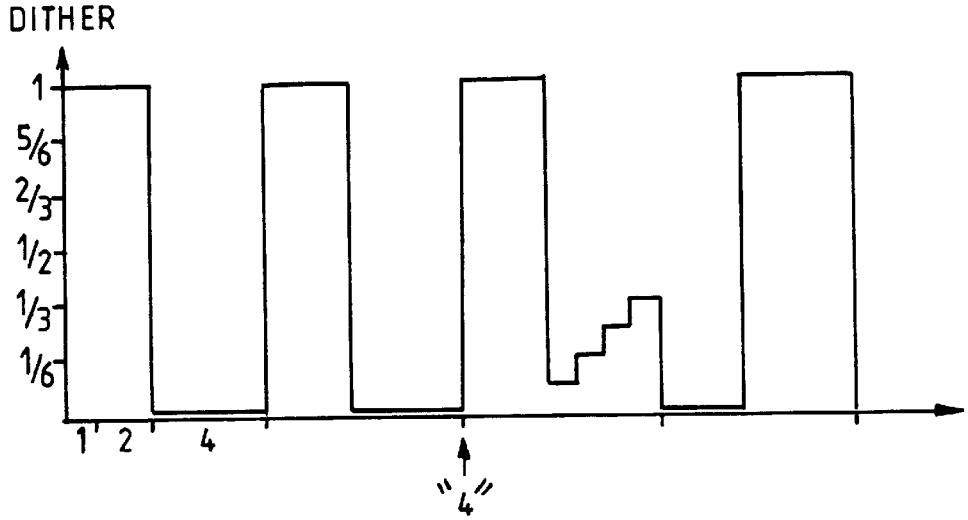
Figure 19B:
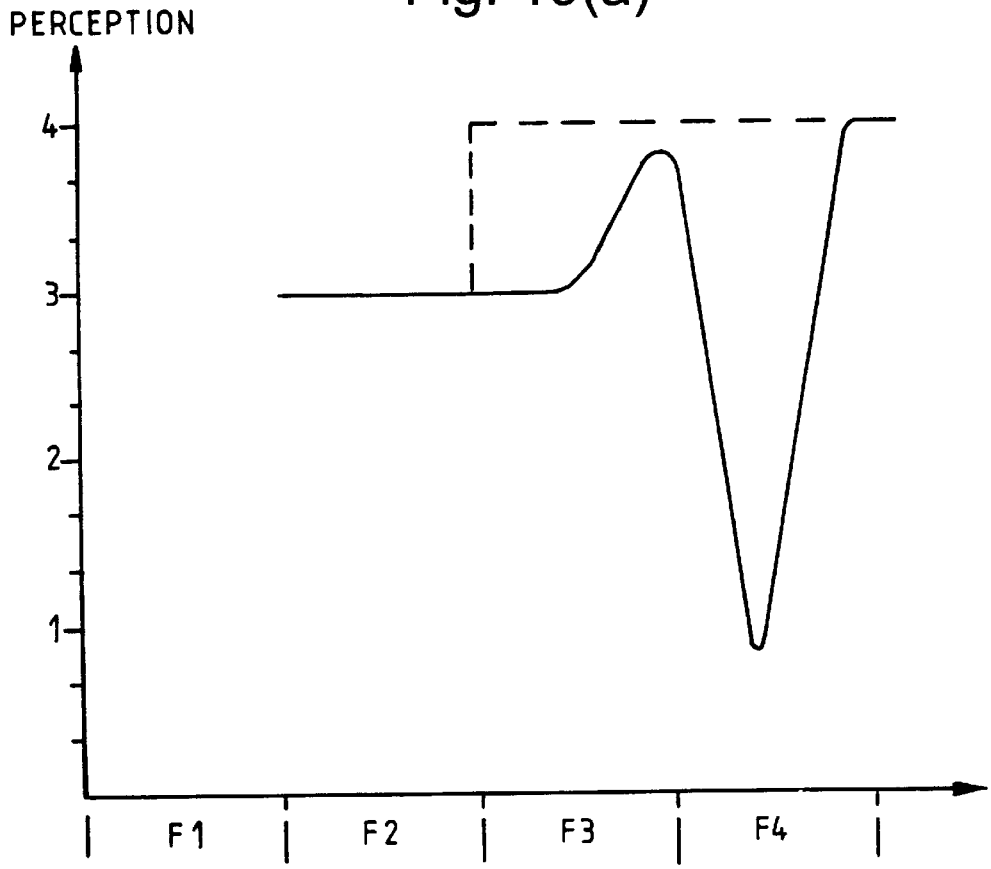
Figure 19C:
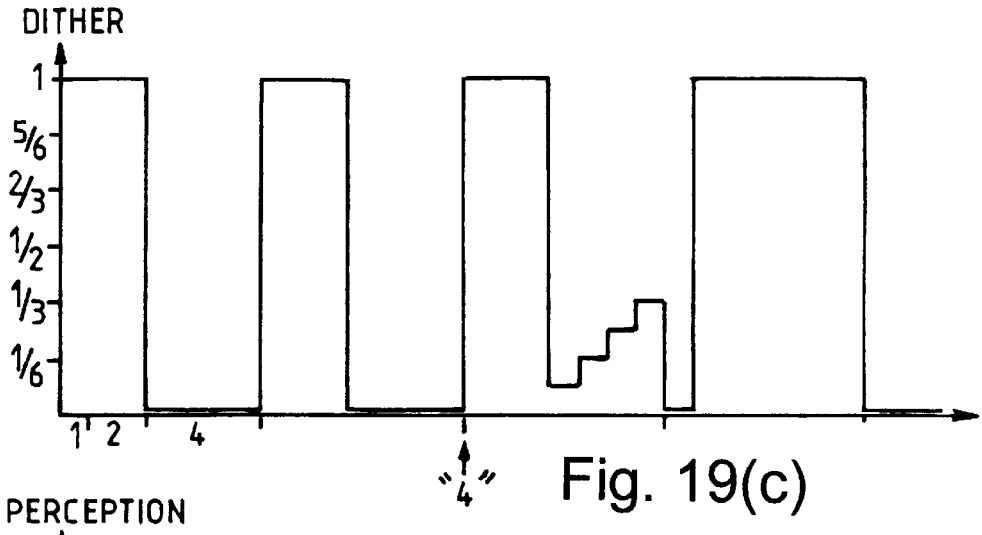
Figure 19D:
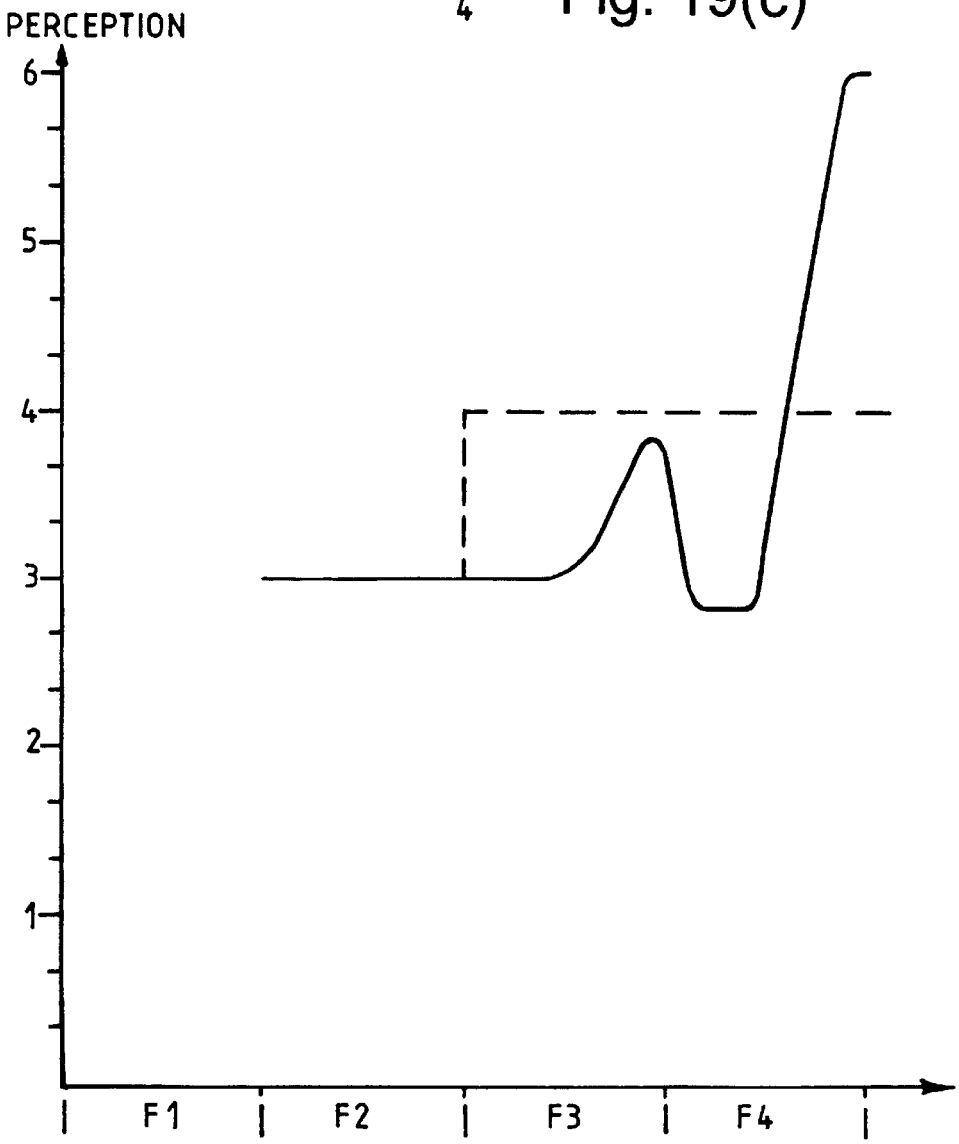

FIGS. 6(*a*) and 6(*b*) are DITHER and PERCEPTION graphs illustrating the problem to which the present invention is directed, FIGS. 6(*c*) and 6(*d*) are DITHER and PERCEPTION graphs illustrating a previous attempt at a solution, albeit in a different field and FIGS. 6(*e*) and 6(*f*) are DITHER and PERCEPTION graphs illustrating an embodiment of the present invention;

FIGS. 7(*a*) and 7(*b*) are DITHER and PERCEPTION graphs illustrating a prior art dither technique error in a different scenario and FIGS. 7(*c*) and 7(*d*) are DITHER and PERCEPTION graphs illustrating the present invention applied to the scenario;

FIG. 8 is a graph of the switching behaviour of a ferroelectric liquid crystal display addressed in the inverted mode of operation;

FIG. 9 shows a pixel is a display panel having a pair of row electrodes for a single pixel;

FIG. 10(*a*) shows a scanning signal for application to one of the row electrodes shown in FIG. 9 and FIG. 10(*b*) shows a scanning signal for application to the other of the row electrodes shown in FIG. 9;

FIGS. 11(*a*) to 11(*d*) show DITHER and PERCEPTION graphs illustrating another embodiment of the invention;

FIG. 12 shows a table of Spatial Dither (SD) and Temporal Dither (TD) values for a combined temporal and spatial dither addressing scheme;

FIGS. 13(*a*) and (*b*) illustrate a problem and solution respectively with the addressing scheme shown in the table of FIG. 12;

FIG. 14 shows a graph of error against absolute grey level for the addressing scheme of FIG. 12;

FIG. 15 shows a graph of error against absolute grey level for the addressing scheme of FIG. 12 including correction in accordance with an embodiment of the present invention;

FIGS. 16(*a*) to (*d*) show DITHER and PERCEPTION graphs corresponding to an alternative embodiment of the present invention; FIG. 17 shows a graph of error against absolute grey scale for the addressing scheme of FIG. 12 including correction according to a further embodiment of the present invention;

FIGS. 18(*a*) to (*d*) show DITHER and PERCEPTION graphs corresponding to an still further embodiment of the present invention;

FIGS. 19(*a*) to (*d*) shows DITHER and PERCEPTION graphs corresponding to yet another embodiment of the present invention;

FIG. 20 shows a pseudocode listing for assessing the correction to be applied by the present invention.

Figure 1:
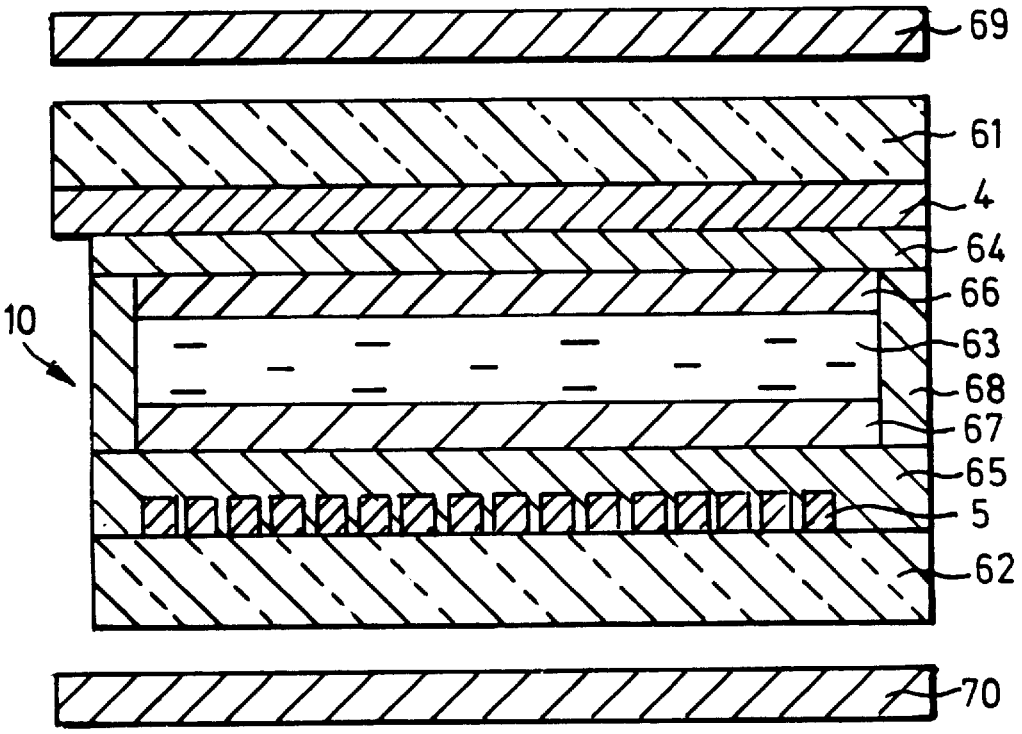
FIG. 1 is a diagrammatic section through a ferroelectric liquid crystal display panel.

The following description will be given by way of example with reference to a large ferroelectric liquid crystal display (FLCD) panel 10 shown diagrammatically in FIG. 1. The FLCD panel 10 comprises a layer 63 of ferroelectric liquid crystal material contained between two parallel glass substrates 61 and 62 bearing first and second electrode structures on their inside surfaces. The first and second electrode structures comprise respectively a series of column and row electrode tracks 4 and 5 which cross one another at right angles to form an addressable matrix of modulating elements (pixels). Furthermore alignment layers 66 and 67 are provided on insulating layers 64 and 65 applied on top of the column and row electrode tracks 4 and 5, so that the alignment layers 66 and 67 contact opposite sides of the ferroelectric liquid crystal layer 63 which is sealed at its edges by a sealing member 68. The panel 10 is disposed between polarisers 69 and 70 having polarising axes which are substantially perpendicular to one another. However it will be understood that such a FLCD constitutes only one type of light modulating device to which the invention is applicable, and the following description of such a display is therefore to be considered as being given only by way of non-limiting example.

Figure 2:
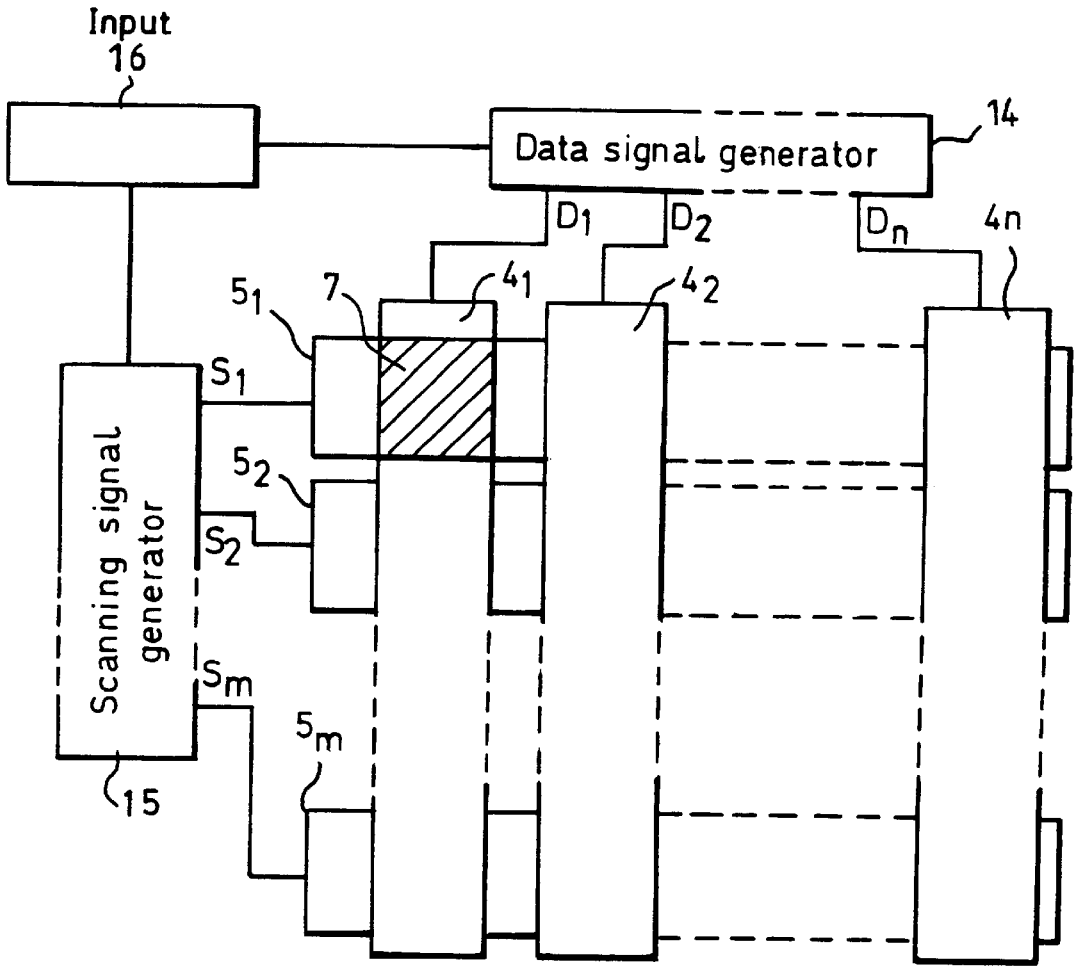
FIG. 2 is a schematic diagram illustrating an addressing arrangement for such a display panel.

FIG. 2 diagrammatically shows an addressing arrangement for such a display panel 10 comprising a data signal generator 14 coupled to the column electrode tracks $\mathbf{4}_1$ $\mathbf{4}_2, \ldots \mathbf{4}_n$ and a scanning signal generator 15 coupled to the row electrode tracks $\mathbf{5}_1, \mathbf{5}_2, \ldots \mathbf{5}_m$. The addressable pixels 7 formed at the intersections of the row and column electrode tracks are addressed by data signals $D_1, D_2, \ldots D_n$ supplied by the data signal generator 14 in association with scanning signals $S_1, S_2, \ldots S_n$ supplied by the scanning signal generator 15 in known manner in response to appropriate image data supplied to the data signal generator 14 and clock signals supplied to the data and scanning signal generators 14 and 15 by a display input 16 which may incorporate spatial and/or temporal dither control circuitry for effecting spatial and/or temporal dither as referred to with reference to FIGS. 4 and 5 below.

Figure 3:
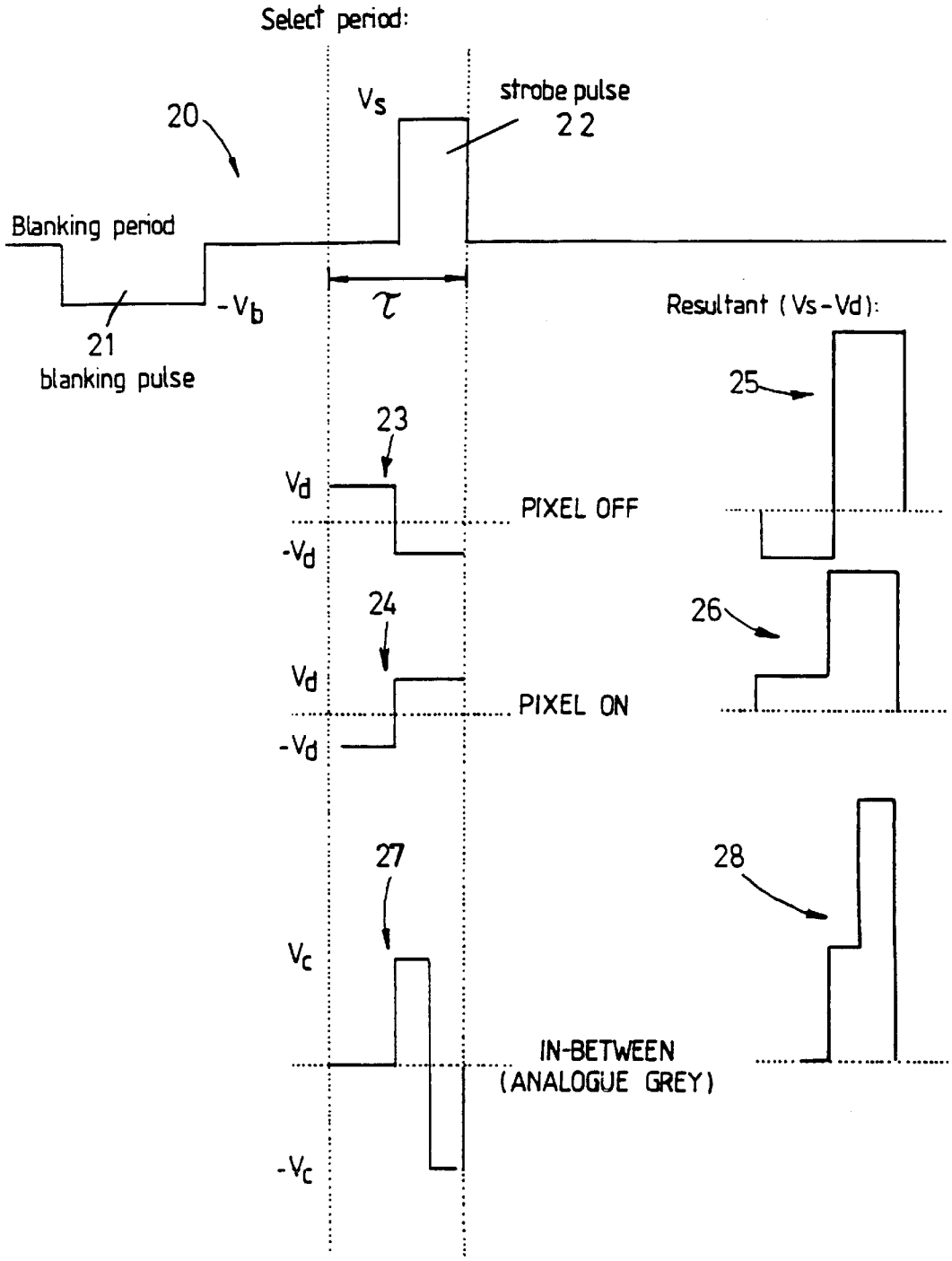
FIG. 3 is an explanatory diagram showing possible waveforms for determining the states of the pixels in such an addressing arrangement.

The manner in which the waveforms of the data and scanning signals supplied to particular column and row electrode tracks determine the switching state of a pixel will now be briefly described with reference to FIG. 3 by way of non-limiting example. FIG. 3 shows a typical scanning waveform 20 comprising a blanking pulse 21 of voltage $-V_b$ in a blanking period and a strobe pulse 22 of voltage $V_s$ in a select period of duration $\tau$, as well as a typical "off" data waveform 23 and a typical "on" data waveform 24 each comprising positive and negative pulses of voltage $V_d$ and $-V_d$. When the blanking pulse 21 is applied to the pixel, the pixel is switched to, or retained in, the normally black state or the normally white state independent of the data voltage applied to the column electrode track (the particular state being dependent on whether white blanking or black blanking is applied). During the select period, the strobe pulse 22 is applied in synchronism with either the "off" data waveform 23 or the "on" data waveform 24 so that the resultant voltage across the pixel determines the state of the pixel and hence the transmission level. When the "off" data waveform 23 is applied, the resultant voltage 25 across the pixel causes the pixel to remain in the same state, that is the state to which the pixel has previously been blanked by the blanking pulse 21, and, when the "on" data waveform 24 is applied, the resultant voltage 26 across the pixel causes the pixel to switch to the opposite state. Furthermore an intermediate data waveform 27, for example of the form shown in FIG. 3 having positive and negative pulses of voltage $V_e$ and $-V_e$, may be applied to the pixel producing a resultant voltage 28 across the pixel which causes the pixel to assume an intermediate state corresponding to an intermediate analogue grey level.

Figure 4:
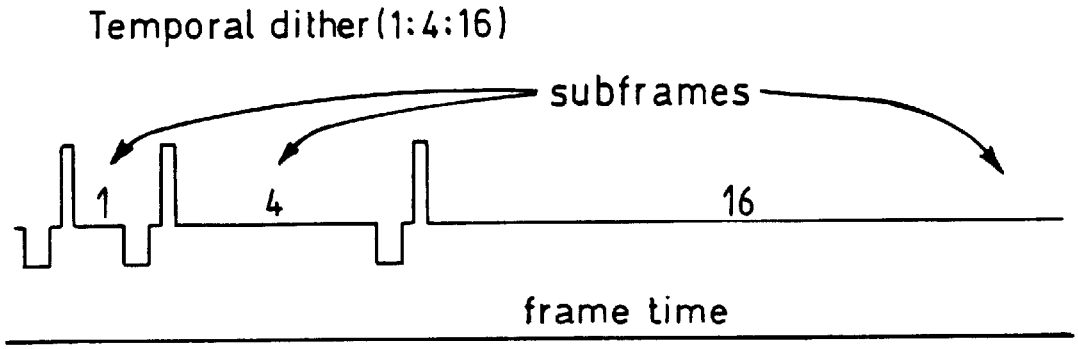
FIGS. 4 and 5 are explanatory diagrams illustrating temporal dither (TD) and spatial dither (SD) techniques.
Figure 5:
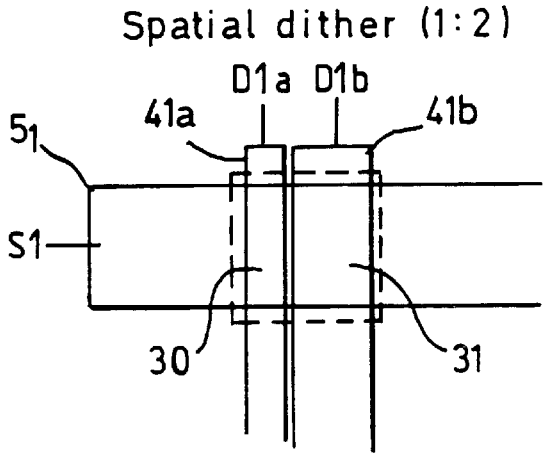
Figure 6A:
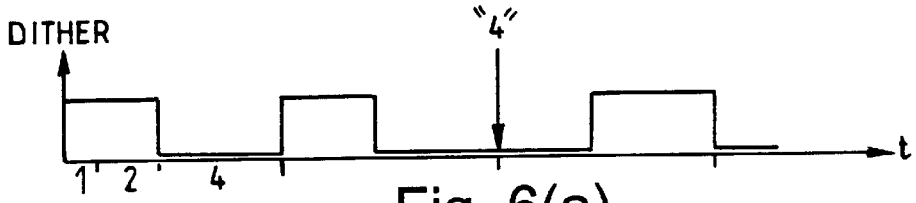
Figure 6B:
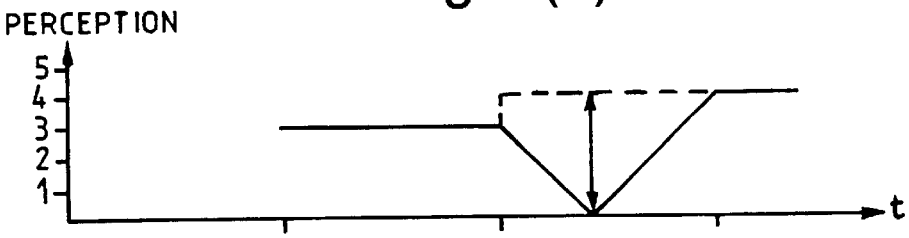
Figure 6C:
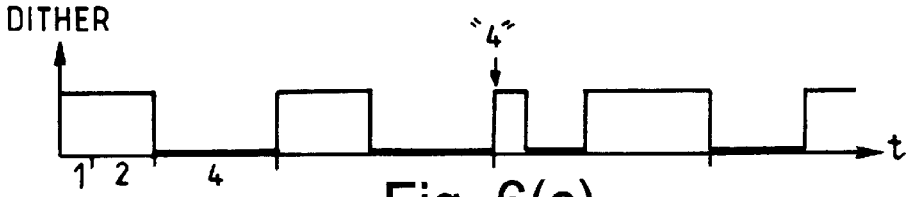
Figure 6D:
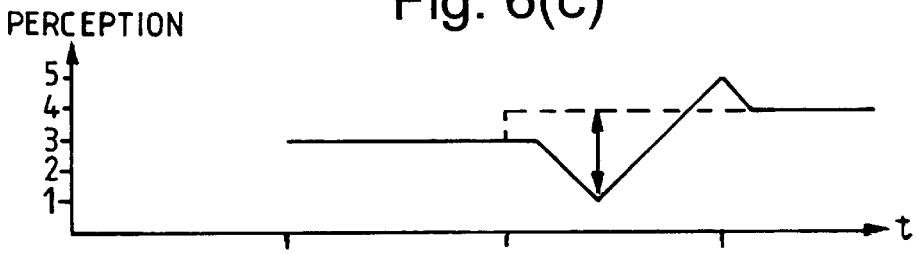
Figure 6E:
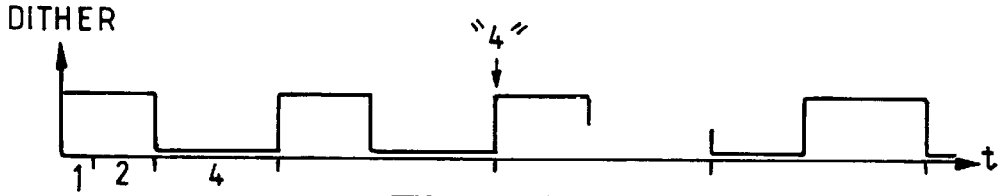
Figure 6F:
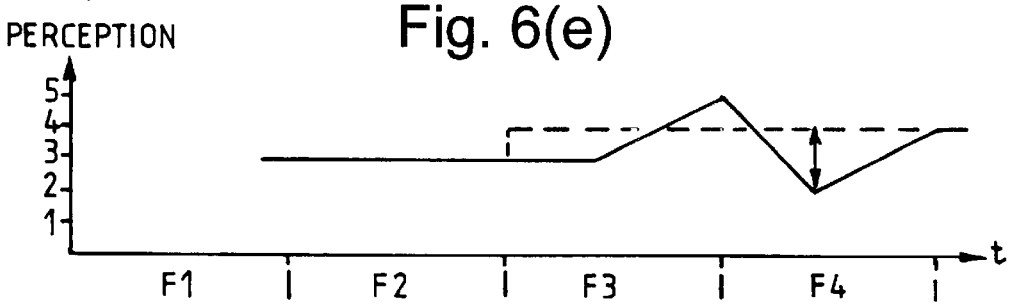
Figure 7A:
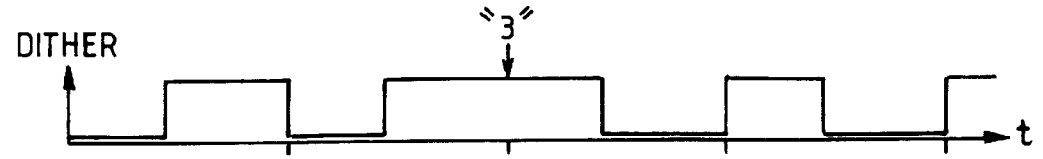
Figure 7B:
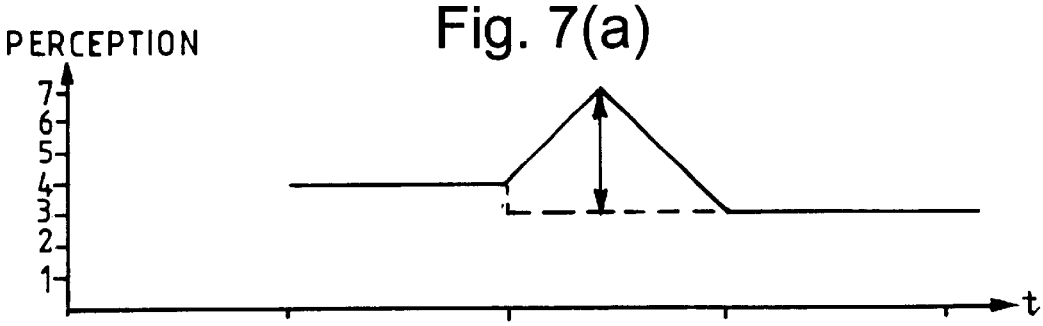
Figure 7C:
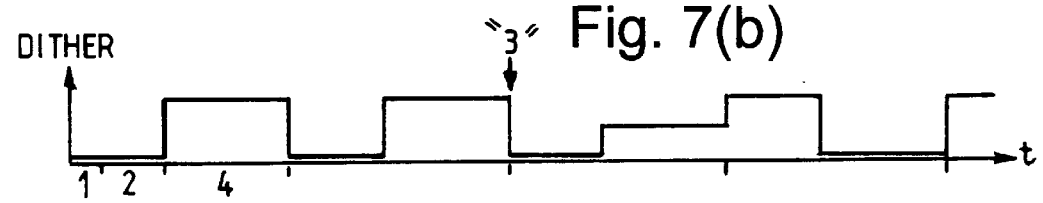
Figure 7D:
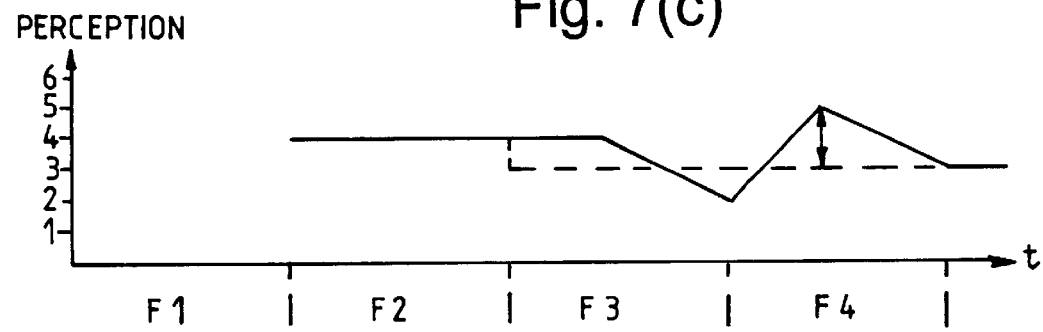

Reference will now be made to FIGS. 4 and 5 to explain possible temporal and spatial dither techniques which may be used in the addressing arrangement to obtain perceived digital grey levels in addition to the analogue grey levels obtainable by application of intermediate data waveforms such as 27 referred to above with reference to FIG. 3. FIG. 4 illustrates the timing of scanning signals applied to a particular row electrode track to achieve temporal dither during a frame time y defining three select periods in the ratio 1:4:16, for example, in which the pixel can be switched to the black state, the white state or any intermediate analogue grey state. The perceived overall grey level within the frame is the average of the transmission levels within the three sub-frames defined by the select periods. FIG. 5 shows a spatial dither arrangement given by way of non-limiting example in which each pixel comprises two sub-pixels 30 and 31 formed, for example, by crossing points of subelectrode tracks $4_{1a}$, $4_{1b}$, with the scanning electrode track $5_1$. Data signals $D_{1a}$, $D_{1b}$ are independently applied to the subelectrode tracks $4_{1a}$, $4_{1b}$ to independently control the transmission levels of the two subpixels and the average of the transmission levels of the two pixels and the ratios of the areas of the pixels determine the overall transmission level of the total pixel.

The two techniques may be applied in combination to provide the desired number of grey levels.

However, application of these techniques is not entirely straightforward and errors arise at changes in greyscale, that is, where two adjacent or successive pixels are required to display different levels of greyscale. In the temporal domain adjoining pixels follow each other in time while, in the spatial domain, they are next to one another in space.

FIG. 6(*a*) of the accompanying drawings shows a conceptualised application of three-bit binary-weighted dither. If we first consider temporal dither, four frames F1, F2, F3 and F4 (indicated in FIG. 6(*f*) relating to a single pixel are shown. Each frame comprises seven sub-frames grouped to provide three bits of temporal dither in the ratio 1:2:4. In frames F1 and F2 the two less significant bits (1 and 2) are light while the most significant bit (4) is dark. Since the relative lengths of these bits is 1:2:4 this results in greyscale having a relative value of 3. However, it is required to change the relative value of the greyscale to 4, which will require a change of the state of the most significant bit (the sub-frame having a relative value of 4). Thus, in frames F3 and F4 the most significant bit is light while the two less significant bits are dark. On a frame-by-frame basis this will result in a change from grey level 3 to grey level 4 between frames F2 and F3. However, in practice this does not occur smoothly.

The duration of the frames F1 to F4 is selected so that the eye cannot distinguish any changes in level on a sub-frame basis. However, the frames should not be so short that the integrating-effect of the eye results in the effect of many past frames still being perceived by the eye. Thus, the eye can just discern seven consecutive sub-frames (one frame) of the addressing. It is not practicable to address a display (particularly a large area display) much more quickly because of the cost, power consumption and heat dissipation of both the display and the driver circuitry.

In FIG. 6(*a*), the change of grey level from a relative value of 3 to a relative value of 4 occurs between frame F2 and frame F3 and is denoted by "4" in this figure. It can be appreciated that the latter part of frame F2 and the earlier part of frame F3 comprise seven consecutive dark sub-frames. Thus, there will be a brief but discernible dark flash from the pixel as it changes from greyscale level 3 to greyscale level 4. Because there will often be a sizeable area of the display over which this change occurs (for example as the darker edge of some displayed feature moves across the display) this is perceived by a viewer as a dark line between areas having a slightly different grey level whose boundary is moving across the screen.

FIG. 6(*b*) illustrates a graph of viewer PERCEPTION which results from the greyscale addressing scheme shown in FIG. 6(*a*). The perception is illustrated as the integration of light transmission over the previous seven sub-frames. This corresponds approximately to the behaviour of the human eye as discussed above. In FIG. 6(*b*) the perception level in frame F1 is not known because we do not know the state of the pixel in the frame preceding frame F1. Because relative grey level 3 was selected in frames F1 and F2 the perception throughout frame F2 is that of relative level 3. At the end of frame F2 grey level 4 is required and hence the sub-frame corresponding to the most significant bit will now be addressed white and the two less significant frames are addressed black. The perception level thus deteriorates from the boundary between frame F2 and frame F3 to a minimum of zero at the start of the most significant bit in frame F3. Because the pixel is now in the white state the perception will climb until it reaches the desired value of 4 at the end of frame F3. This is shown by the solid line in FIG. 6(*b*) while the desired level is shown by a broken line. In the example given, it can be seen that the wrong level of greyscale is displayed for seven frames and, at the worst point, there is a error of four relative levels of greyscale (zero transmission).

Alternatively the perception can be considered as an average over each of the frames.

An analogous problem occurs in spatial dither arrangements. If FIG. 6(*a*) is considered again, F1, F2, F3 and F4 may represent adjacent pixels on a particular line. Pixels F1 and F2 are intended to display a relative greyscale level of 3 and pixels F3 and F4 are intended to display a greyscale level of 4. However, the right-hand end of pixel F2 and the left-hand end of pixel F3 will occupy a dark state which is a whole pixel in length. Thus, there will be a dark portion between an area of greyscale of value 3 and an adjacent area of greyscale having a value of 4. In the case of spatial dither it is not necessary for the image to be moving for this problem to be apparent.

A similar problem has been addressed in the field of plasma display panels (PDPs). This has received attention in "An equalizing pulse technique for improving the greyscale capability of plasma displays" by K. Toda et al. and published in Euro-Display '96 pp. 39–42. FIGS. 6(*c*) and 6(*d*) illustrate the technique described therein when applied to the instant case. FIG. 6(*c*) illustrates the state of the sub-frames of the pixel. In sub-frame F3 (where relative grey level 4 is required) an extra pulse is included, effectively making frame F3 display a relative grey level of 5. The single sub-frame pulse interrupts the seven sub-frame period of dark level which is present in FIG. 6(*a*). FIG. 6(*d*) shows the PERCEPTION of a human eye observing such a pixel, calculated as above. As can be seen, the duration of the perceived error in grey level has actually lengthened by one sub-frame. However, the largest absolute error in grey level has been reduced to 3 grey level gradations from 4.

FIGS. 6(*e*) and 6(*f*) illustrate one example of an addressing technique in accordance with the present invention. In this example, the most significant bit of the dither technique can be addressed to provide a half level. The technique for providing this level will be discussed subsequently and include analogue grey level, twin scanning electrode lines per pixel and other suitable techniques. Following the point between frames F2 and F3 at which relative grey level 4 is requested, the addressing is modified during transitional frame F3. The two less significant bits are maintained at level 1 while the most significant bit is addressed at a half level. Thus, the intermediate frame F3 corresponds to a transmission level of 5.

As can be seen from FIG. 6(*f*) the perception (calculated as above) shows that this technique results in a lower absolute error in the relative grey level than that described with reference to FIGS. 6(*c*) and 6(*d*). The desired grey level is shown again in dotted lines and this departs from the actual perception level for two frames, F3 and F4. However, the period for which the error in perception exceeds one relative grey level is only three sub-frames compared with six sub-frames for the technique shown in FIGS. 6(*a*) and 6(*b*) and four sub-frames for the technique shown in FIGS. 6(*c*) and 6(*d*).

An analogous problem arises in a temporal dither arrangement which is changing from greyscale level 4 to greyscale level 3. This is shown in FIGS. 7(*a*) and 7(*b*) of the accompanying drawings but, in this case, the error which exists between frames F2 and F3 will occupy the light state and so the line between the areas at different levels of greyscale will be a white line rather than a dark line. Frames F2 and F3 are shown as having a relative level of 4 and level 3 is requested for frame F3 and frame F4. The error occurs in reverse as shown in the PERCEPTION graph of FIG. 7(*b*). The error in perceived grey level is of the same magnitude and the same duration as that shown in FIG. 6(*b*). However, because the seven sub-frames bridging frame F2 and F3 all occupy the light state, the error in perception results in a level of white.

FIG. 7(*c*) shows the technique of the present invention applied to this case. Instead of the two less significant sub-frames occupying the white state in frame F3, the most significant sub-frame is activated to provide a half level equivalent to a relative grey level of 2. As expected, the PERCEPTION curve shown in FIG. 7(*d*) is effectively the reverse of that shown in FIG. 6(*f*). The perceived relative grey level is only in error by more than one relative grey level for three sub-frames.

This perceived error is sometimes referred to as pseudo-edge because it places an erroneous edge to areas of different greyscale levels.

One means by which the half transmission level in the most significant bit can be obtained is by way of a so-called analogue grey level. In a ferroelectric liquid crystal device it is possible, by varying the combination of voltage and duration of the applied signal, to only partially change the state of a pixel. FIG. 8 shows a schematic graph of a surface stabilized ferroelectric liquid crystal device (SSFLCD) addressed in the inverted mode as described in the JOERS/Alvey ferroelectric addressing scheme. The combination of time ($\tau$) and voltage (V) combined to switch the pixel (shaded area SW) or not to switch the pixel (clear area NSW) are shown. However, not all of the domains within a pixel will respond to a particular combination of time and voltage. Thus, some parts of the pixel will change state at certain combinations of time and voltage which will not cause other parts of the pixel to change state. Thus, FIG. 8 shows two curves, a 0% curve which represents combinations of time and voltage which just start to cause isolated parts of the pixel to switch, and a 100% curve which corresponds to combinations of time and voltage which guarantee that the whole pixel will have changed state (10% and 90% curves are also typical). By addressing the pixel with combinations of time and voltage that fall between the 100% curve and the 0% curve it is possible to partially switch a pixel. This results in a transmission level intermediate the white and black states and is called analogue grey. P. Maltese, F. Campuli, A. Alessandro, V. Foglietti, A. Galbarto, A. Galloppa, G. Rafaelli & M. Wnek, Ferroelectrics, 179, 153 (1996) and W. J. A. M. Hartmann, J. Appl. Phys. 1989 v. 66 at 1132 describe the technique in more detail.

There are two main problems with this approach, however, as follows. The differences in the $\tau$V products which correspond to 0% transmission and 100% transmission are close together which places stringent demands on the timing and voltage accuracy of the driving circuitry. In addition, as the temperature of a ferroelectric liquid crystal display changes (typically rising in use), the curves shown in FIG. 8 shift approximately in the up and down direction. Thus, a driving signal with a $\tau$V combination which results in 50% transmission when the device is cold may result in a somewhat different transmission level when the device is heated up.

One solution to this problem is shown in FIG. 9. In this case the row electrode (5$_1$ in FIG. 2) to which the scanning signal is applied is separated into two row electrodes R1 and R1'. The intersection of these with a column electrode having 1:2 spatial dither is shown. Column C1 is twice as wide as column C1' and these are addressed as described with reference to FIG. 5 to provide 1:2 spatial dither. The areas over which the row electrodes R1 and R1' intersect with the column electrodes C1 and C1' are shaded and constitute a single pixel of the device. The two row electrodes R1 and R1' are addressed by scanning signals which are inverted with respect to one another. FIG. 10(*a*) shows part of a scanning signal applied to row electrode R1. FIG. 10(*b*) shows part of a scanning signal applied to row R1', to the same time scale. These waveforms will be of the type as described with reference to FIG. 3. The only difference is that one is the inverse of the other.

Because the blanking pulses of the two scanning signals have opposite polarities, pixels in row R1 will be blanked to black (for example) while pixels in row R1' will be blanked to white. When the subsequent strobe pulses are applied in conjunction with data waveforms giving τV products for producing analogue grey scale, row R1 and row R1' will be switched in opposite directions. In the case of a desired 50% analogue grey level, one of the sub-rows will be blanked black and switched to 50% white while the other row will be blanked white and switched to 50% black. Variations in the drive voltage (V), time applied (τ) or the temperature of the device will thus have equal and opposite effects on the switching of pixels in sub-row R1 and sub-row R1'. In the extreme case, where the τV curve moves to a great extent and the switching in conjunction with the strobe pulses fails completely, a 50% level (provided by 100% on one row and 0% on the other row) will still be obtained.

A disadvantage of this technique is that double the number of rows R1, R1' is required and double the number of driving circuits is required. As an alternative, an interlaced technique which blanks alternate (complete) rows of the array to different states has been proposed. Each row is blanked, for example, to the dark state in a first frame and then to the light state in the following frame and so on. When a particular row is blanked to the dark state the following row, in space, will be blanked to the dark state. This has been found in practice to provide equivalent performance to the split-row technique described with reference to FIGS. 9 and 10 without the consequent doubling in row driver circuitry.

By reference to FIG. 6(*f*) or FIG. 7(*d*) the error in perception provided by the present invention is slightly lopsided. Considering FIG. 6(*f*) it can be seen that the positive error (excessive light transmission) is one sub-frame at the boundary between frame F3 and F4. The negative error (too little light transmission) is two relative levels of grey part-way through frame F4 (shown by the vertical arrow). FIGS. 11(*a*) to 11(*d*) illustrate a technique for providing a more even (and hence less perceptible) perceived error. In this case, the most significant bit may occupy transmission levels of 0, ⅓, ⅔ or 1.

FIG. 11(*a*) shows this aspect of the present invention applied to a change in transmission level from 3 to 4. The signal applied differs from that shown in FIG. 6(*e*) by providing a transmission level of ⅔ during the most significant part of frame F3. The resulting PERCEPTION curve is shown in FIG. 11(*b*) which is calculated as described for those in FIG. 6. The greatest error in perception is now equal to 1⅔ grey scale gradations at the transition from frame F3 to frame F4. The negative-going error part-way through frame F4 has been decreased to a relative grey level of one and one third. The intermediate level of the sub-frame applied during frame F3 could be reduced slightly so that the positive-going and negative-going errors are equal.

FIGS. 11(*c*) and 11(*d*) show the equivalent scenario for a change from relative grey level 3 to relative grey level 4. The addressing signal in this case is analogous to that shown in FIG. 7(*c*) but with a relative grey level of one third applied during the most significant bit of frame F3. This results, as expected, in the perception curve shown in FIG. 11(*d*) which is the inverse of that shown in FIG. 11(*b*).

While the present invention has been described in the context of 1:2:4 digital dither for simplicity, it is applicable to changes of state which do not involve the most significant bit changing state and to combinations of spatial and temporal dither. FIG. 12 shows a table of certain of the states (together with their constitution) in an addressing scheme combining 1:2 spatial dither and 1:4:16 temporal dither. The left-hand column indicates the relative grey level from zero upwards, while the remaining columns indicate how this is achieved. The second column corresponds with the smaller part of the pixel in spatial dither (SD1), while the third column represents the larger part of the pixel (SD2). The remaining three columns relate to the sub-division of a frame in temporal dither, the fourth column corresponds with the sub-frame of relative duration 1 (TD1), the fifth column with the sub-frame of relative duration 4 (TD4) and the sixth column with the sub-frame of relative duration 16 (TD16). For a relative level of 0, neither part of the pixel is activated for any time period corresponding in a black level. For a relative grey level of 1, spatial dither bit 1 is combined with temporal dither bit 1. For relative grey level 2, spatial dither bit 2 is combined with temporal dither bit 1. For relative grey level 3, both spatial bits are combined with temporal dither bit 1. For relative grey level 4, spatial dither bit 1 is combined with temporal dither bit 4 while for relative grey level 5, spatial dither bit 1 is combined with temporal dither bits 1 and 4. For a relative grey level of 6, spatial dither bit 2 is combined with temporal dither bit 1 and spatial dither bit 1 is combined with temporal dither bit 4.

The procedure continues up until level 15 in which both spatial dither bits are combined with temporal dither bits 1 and 4. To provide grey level 16 spatial dither bit 1 is combined with temporal dither bit 16. Thus, a variation in grey level between 15 and 16 will result in the dynamic digital error problem. The present invention may respond only to this one transition or to a limited number of transitions that result in pseudo-edge effects.

For example, a similar problem manifests itself between grey levels 31 and 32, and between grey levels 47 and 48. In an alternative embodiment, these three transitions are responded to.

Thus, applying the present invention to this combination of digital dither, any variation which results in a change of state of temporal dither bit 16 results in application of the above-described compensation technique. Spatial dither bits 1 and 2 are provided with the intermediate transmission level (for example half or one third and two thirds and so on) and this is applied in the intermediate frame. FIGS. 13(*a*) and 13(*b*) show the transition from relative grey level 15 to relative grey level 16. FIG. 13(*a*) illustrates the problem which occurs when no correction is applied. During frame F1, spatial dither SD1 and SD2 are applied during the temporal dither periods TD1 and TD4 (shown along the horizontal axis). At the start of frame F2, spatial dither bit 1 is applied in conjunction with temporal dither bit 16 thus providing a relative grey level of 16 over the frame. However, there is a frame-length duration spanning frames F1 and F2 with zero transmission. This will result in the dynamic digital error discussed previously.

By contrast, the dither signal shown in FIG. 13(*b*) incorporates the teaching of the present invention. Frame F2 comprises temporal dither bits 1 and 4 applied in conjunction with both spatial dither bits 1 and 2 followed by a half level in temporal dither bit 16. In frame F3 spatial dither bit 1 is applied in conjunction with temporal dither bit 16 to give the desired transmission level.

The technique of adding or subtracting light transmission described with reference to FIG. 6(*c*) may be applied in the next frame to further ameliorate the pseudo-edge problem.

FIG. 14 shows a graph of the error between a combined spatial and temporal dither addressing arrangement as shown in the table of FIG. 12. The horizontal axis of FIG. 14 shows the desired grey level between 0 and 63. The vertical axis shows the error from the desired grey level, a negative value denoting too little light transmission and a positive value denoting too much. To generate the graph, each desired grey level was requested in turn, allowing the grey level to "settle". Small errors can be seen to occur whenever the temporal dither bit 4 is changed, for example at the transition between levels 3 and 4, 7 and 8 and so on. As expected, the most significant errors occur when the state of temporal dither bit 16 is changed, at the transition between levels 15 and 16, 31 and 32, and 47 and 48.

The bits can be re-ordered to reduce the effects of pseudo-edge. The three curves of FIG. 14 illustrate the relative performance but the error in each case is still significant.

FIG. 15 shows the same combination of temporal and spatial dither corrected by means of the present invention. The correction is only applied to the temporal MSB in this case. As can be seen, the level of error at the transition involving the most significant temporal dither bits 16 have been significantly reduced. The invention may also be applied to transitions involving less significant bits of the digital dither technique.

As in the case of the curves shown in FIG. 14, the effects of re-ordering the bits are also shown.

As can be seen, there is a reduced but finite error remaining in these results. An embodiment of the invention which reduces this error will now be described with reference to FIGS. 16(*a*) to 16(*d*). In FIG. 16(*a*) the dither signal applied differs from that in FIG. 6(*e*) in that, during frame F3, the dither bit 1 is omitted. Dither bit 1 is included, instead, at the start of frame F4. The PERCEPTION curve (calculated as described previously) is shown in FIG. 16(*b*). While this method for deriving perception does not show this to be a marked improvement, it is nonetheless worthwhile. (The human factors involved are not yet fully understood).

FIG. 16(*c*) shows the corresponding scenario when the grey level is changed from relative grey level 4 to level 3. As expected, the perception curve shown in FIG. 15(*d*) is the reverse of that shown in FIG. 16(*b*).

The improvement given by this embodiment of the invention is more significant when a larger number of grey levels are involved. FIG. 17 is a new version of the graph shown in FIGS. 14 and 15 in which the "shifted least significant bit" feature of the invention is utilized. As can be seen from the graph, the error in grey levels is much reduced.

A further improvement in the present invention can be provided by re-ordering the dither bits in conjunction with the modified level of the most significant bit. The three alternatives are illustrated in the figure as before.

FIGS. 18(*a*) to 18(*d*) illustrate this embodiment. In common with the earlier graphs, FIG. 18(*a*) gives the dither applied when the required level of greyscale changes from 3 to 4 between frames F2 and F3. FIGS. 18(*c*) and 18(*d*) show the reverse situation in which the desired level of greyscale alters from 4 to 3 between frames F2 and F3.

From the PERCEPTION graphs shown in FIGS. 18(*b*) and 18(*d*) the perceived error in grey scale now does not exceed 1 grey level gradation.

FIGS. 19(*a*) to 19(*d*) illustrate an alternative correction technique when using analogue grey scale to provide the intermediate level in the most significant bit. In practice, unless there are very fast ions in the liquid crystal, the analogue grey scale requested will not actually appear in practice. The analogue grey scale demanded by the addressing scheme will take a finite time to actually provide the relevant level of light transmission. FIG. 19(*a*) shows how this might occur in a switch from grey level 3 to grey level 4 in a 1:2:4 temporal dither technique. Grey level 4 is requested at the transition between frame F2 and frame F3. In common with the first embodiment described with reference to FIG. 6(*e*), dither bits 1 and 2 are addressed during frame F3. Ideally, the remainder of frame F3 should be at analogue grey level 1/2. However, because of the finite time required to attain that level, the transmission is as shown in FIG. 19(*a*) over the four sub-frames of the most significant bit of frame F3 the transmission level of the most significant bit corresponds to 1/12, 1/6, 1/4 and 1/3 (shown for ease of calculation as a staircase, although in practice, of course, a continuous increase in transmission level would occur). Frame F4 then corresponds to a transmission level of 1 during the most significant temporal bit 4.

FIG. 19(*b*) shows the resultant perception curve calculated as described previously. By comparison with FIG. 6(*f*) it can be seen that a somewhat larger error occurs than in the theoretical results.

FIG. 19(*c*) shows a partial solution to this problem. The temporal bit 2 is also placed in state 1 during frame F4 as well as temporal bit 4.

FIG. 19(*d*) shows the PERCEPTION curve calculated as described previously. The error in transmission level has been reduced from that shown in FIG. 18(*b*).

As before, the reverse scenario occurs for transition from relative grey level 4 to relative grey level 3.

The present invention may also be applied in conjunction with digital weightings of the bits which are not true binary. Typically, the most significant bit is less than double the size of the next most significant bit.

Numerous techniques for addressing the device according to the invention will be apparent to the skilled reader. In one case this may comprise a look-up table to determine the intermediate level for each transition. This can be consulted for a restricted number of transitions (that is those that cause particular pseudo-edge effects) or for every possible transition. The table can be generated by determining the bit pattern for each grey level and the transition to all possible other levels. Since a particular grey level there may be provided in a number of different ways, the "originating level" part of the table may need to provide more levels than the actual physical grey levels provided. whether and to what extent correction according to the invention is applied might depend upon the actual manner in which a particular grey level is provided.

The took up table can be visualised as a two dimensional array with the original grey level on one axis and the final grey level on the other axis. In some cases the final level required ("the command level") will not be achieved because the command level has changed again in the intervening frame. This does not matter and the lookup table will still provide the best compromise "intermediate" frame again. In practice it might be a long time before a "settled" command frame is acheived.

The intermediate frame placed in the table can be at an average value between the original and final levels.

Another frame store may be provided so that known addressing circuitry can store the "command" values while the additional frame store stores the actual values that are currently being displayed. These two can then be fed to the lookup table as the device is operating.

Alternatively the intermediate frame can be determined by calculating the average grey level for the relevant temporal dither sequence when moving from a first grey level to a second grey level. This can be performed in software as the simple example shown in FIG. 20 illustrates.

The above description is directed specifically to the static pseudo edge problem which is perceived when the viewer fixes on a point on the display as an image moves past that point on the display. However the invention is also applicable to the more difficult, dynamic pseudo edge problem where the viewer tracks a fast moving edge over the display. Whilst the invention can improve the perceived error in the dynamic case also, the improvement in the perceived error is not as great as in the static case.

Figure 21A:
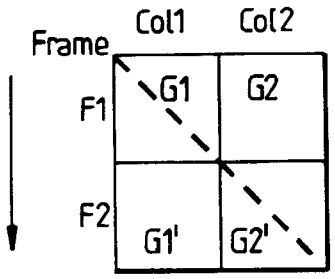
Figure 21B:
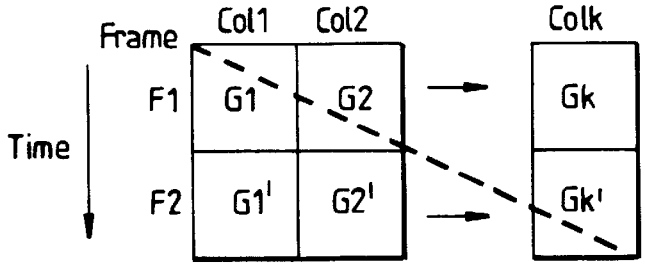
Figure 21C:
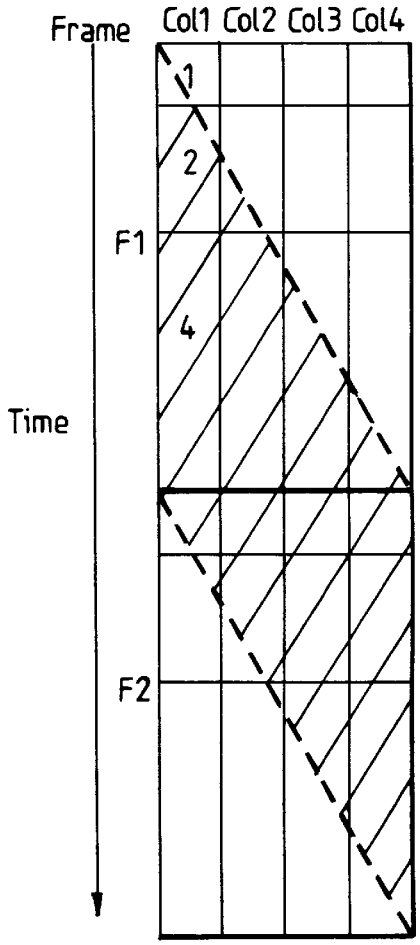

The dynamic pseudo edge problem can be better understood by referring to FIGS. 21(*a*), 21(*b*) and 21(*c*).

FIG. 21(*a*) diagrammatically illustrates the successive transmission levels G1, G1' and G2, G2' of two pixels in adjacent columns COL1, COL2 over successive frames F1 and F2. If the example is considered of an image moving across the display at 1 pixel per frame (ppf), the viewer's eye will track an edge from one pixel to the next over time, and this is represented by the dotted line in FIG. 21(*a*) indicating tracking by the viewer's eye as the edge moves from COL1 to COL2. In this case, instead of the perceived grey level being determined by level G1 followed by level G1', that is the transmission levels of the same pixel in successive frames, the perceived level is determined by the level G1 followed by the level G2', which is of course the transmission level of a different pixel to that contributing to the perceived level in frame F1. If the speed of the image is increased, the perceived edge moves across all pixels during the equivalent time period. The general case in which the edge moves across k pixels during the time period spanning frames F1 and F2 is shown in FIG. 21(*b*), the edge in this case moving at k ppf. In this case the observer will interpolate the different transmission levels seen in passing between the start and end points in arriving at the perceived grey level which will be made up of contributions from the levels of COL1, COL2 . . . COLk over the frames F1 and F2.

Figure 22:
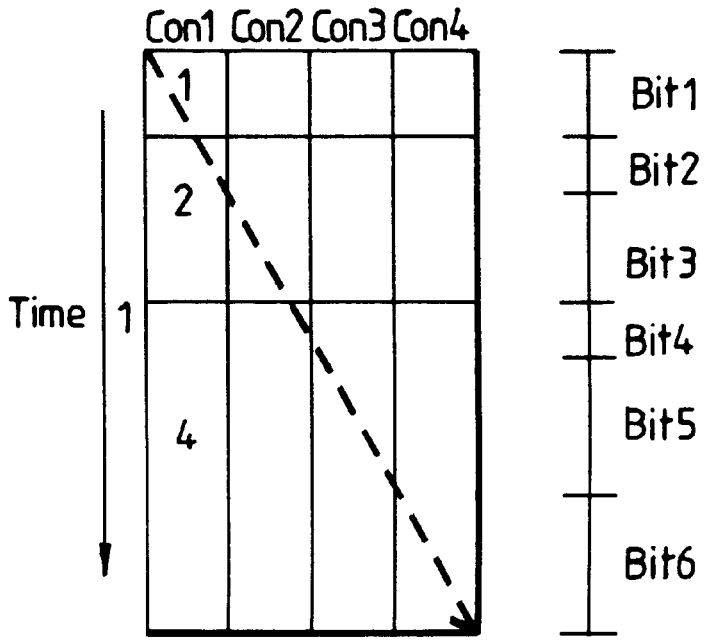

FIG. 21(*c*) illustrates the case in which the pixels are addressed by three bits of temporal dither in the ratio 1:2:4, and the dotted lines indicate tracking of an edge moving at 3 ppf over two frames F1 and F2. The changing transmission level seen as the viewer follows the moving edge is represented in the figure by the area between the two dotted lines. Furthermore the average transmission level between the two dotted lines is also the perceived transmission level observed by the viewer. The same technique can be used to calculate the perceived transmission level as is used in the static case, except that each TD bit is now generated from the four pixels over the columns COL1, COL2, COL3 and COL4. To simplify this calculation the 3-bit TD can be subdivided at the pixel boundaries to produced a 6-bit TD sequence as shown in FIG. 22. In general, for an n-bit TD sequence moving at k ppf, a new TD sequence can be generated with (n+k)-bits. If the pixel and TD boundaries fall at the same point, the particular bit size is 0. In the 3-bit TD example of FIG. 22, the TD sequence is modified to 1:¾:1¼:½:1¾:1¾ (or 4:3:5:2:7:7). The bits are made up of the four pixels as follows: first pixel—bits 1,2, second pixel—bits 3,4, third pixel—bit 5 and fourth pixel—bit 6.

Figure 23:
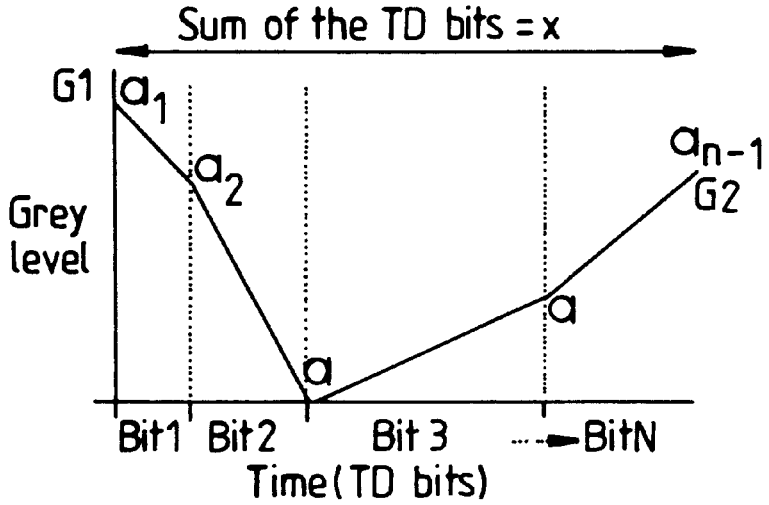

The average grey level for the transmission between the grey levels G1 and G2 can be represented by a transmission plot as shown in FIG. 23. This shows the change in grey level over N TD bits, where $a_1$, $a_2$, $a_3$ . . . $a_n$ represents the grey level at the start of each bit.

What is claimed is:

1. A light modulating device comprising an addressable matrix of modulating elements, and addressing means for selectively addressing each element in order to vary the transmission level of the element relative to the transmission levels of other elements, the addressing means including spatial and/or temporal dither means for addressing separately addressable spatial bits of each element with different combinations of spatial dither signals and/or for addressing at least part of each element with different combinations of temporal dither signals applied to separately addressable temporal bits corresponding to subframes of different periods to produce a plurality of different transmission levels, and state selection means for switching at least a part of each element between different states corresponding to different transmission levels by means of ON and OFF switching signals, wherein the state selection means includes transition responsive means for providing a transitional transmission level in response to a transition in transmission level between adjacent elements and/or successive frames, which transition involves changing the state of one of the bits between a first state corresponding to a first transmission level and a second state corresponding to a second transmission level, said transitional transmission level involving changing the state of said one bit to an intermediate state corresponding to a transmission level which is intermediate the first transmission level and the second transmission level.

2. A light modulating device as claimed in claim 1, wherein the state selection means includes means responsive to at least two transitions in transmission level between adjacent elements and/or successive frames.

3. A light modulating device as claimed in claim 2, wherein the state selection means includes means responsive to all possible transitions in grey level between adjacent elements and/or successive frames.

4. A light modulating device as claimed in claim 1, wherein said intermediate state corresponds to an analogue transmission level.

5. A light modulating device as claimed in claim 4, wherein the analogue transmission level is in the most significant bit.

6. A light modulating device as claimed in claim 1, wherein the transmission level of said intermediate state varies in response to the first state of the bit being a dark state or a light state.

7. A light modulating device as claimed in claim 1, wherein the transmission level of said intermediate state is substantially half of the maximum transmission level of that bit.

8. A light modulating device as claimed in claim 1, wherein the transmission level of said intermediate state is selected from one third and two thirds of the maximum transmission level of that bit.

9. A light modulating device as claimed in claim 8, wherein the transmission level of said intermediate state is selected to be one third of the maximum in response to a transition from the first state to the second state, and two thirds of the maximum in response to a transition from the second state to the first state.

10. A light modulating device as claimed in claim 1, wherein at least a most significant bit of each modulating element of the matrix comprises two scanning lines.

11. A light modulating device as claimed in claim 10, wherein the state selection means includes means for applying signals to each of the scanning lines, which signals are inverted with respect to one another for providing the transmission level of said intermediate state.

12. A light modulating device as claimed in claim 1, wherein the state selection means includes means for applying signals to adjacent scanning lines, which signals are inverted with respect to each other.

13. A light modulating device as claimed in claim 1, wherein the state selection means includes a look-up table responsive to the first state and the second state for providing said intermediate state.

14. A light modulating device as claimed in claim 13, wherein the look-up table is responsive only to a predetermined proportion of the possible transition between states.

15. A light modulating device as claimed in claim 13, wherein the transmission level of said intermediate state is an average between the first transmission level of the first state and the second transmission level of the second state.

16. A light modulating device as claimed in claim 1, wherein the addressable matrix of modulating elements comprises a ferroelectric liquid crystal display.

17. Means for driving a light modulating device which comprises an addressable matrix of modulating elements, the means comprising addressing means for selectively addressing each element in the device in order to vary the transmission level of the element relative to the transmission levels of other elements, the addressing means including spatial and/or temporal dither means for addressing separately addressable spatial bits of each element with different combinations of spatial dither signals and/or for addressing at least part of each element with different combinations of temporal dither signals applied to separately addressable temporal bits corresponding to subframes of different periods to produce a plurality of different transmission levels, and state selection means for switching at least a part of each element between different states corresponding to different transmission levels by means of ON and OFF switching signals, wherein the state selection means includes transition responsive means for providing a transitional transmission level in response to a transition in transmission level between adjacent elements and/or successive frames, which transition involves changing the state of one of the bits between a first state corresponding to a first transmission level and a second state corresponding to a second transmission level, said transitional transmission level involving changing the state of said one bit to an intermediate state corresponding to a transmission level which is intermediate the first transmission level and the second transmission level.

18. Means for driving a light modulating device as claimed in claim 17, wherein the state selection means includes means responsive to at least two transitions in transmission level between adjacent elements and/or successive frames.

19. Means for driving a light modulating device as claimed in claim 18, wherein the state selection means includes means responsive to all possible transitions in transmission level between adjacent elements and/or successive frames.

20. Means for driving a light modulating device as claimed in claim 17, wherein said intermediate state corresponds to an analogue transmission level.

21. Means for driving a light modulating device as claimed in claim 20, wherein the analogue transmission level is in the most significant bit.

22. Means for driving a light modulating device as claimed in claim 17, wherein the transmission level of said intermediate state is varied in response to the first state of the bit being a dark state or a light state.

23. Means for driving a light modulating device a claimed in claim 17, wherein the transmission level of said intermediate state is substantially half of the maximum transmission level of that bit.

24. Means for driving a light modulating device as claimed in claim 17, wherein the transmission level of said intermediate state is selected from one third and two thirds of the maximum transmission level of that bit.

25. Means for driving a light modulating device as claimed in claim 24, wherein the transmission level of said intermediate state is selected to be one third of the maximum in response to a transition from the first state to the second state, and two thirds of the maximum in response to a transition from the second state to the first state.

26. Means for driving a light modulating device as claimed in claim 17, wherein at least a most significant bit of each modulating element of the matrix comprises two scanning lines.

27. Means for driving a light modulating device as claimed in claim 26, wherein the state selection means includes means for applying signals to each of the lines, which signals are inverted with respect to one another for providing the transmission level of said intermediate state.

28. Means for driving a light modulating device as claimed in claim 17, wherein the state selection means includes means for applying signals to adjacent scanning lines, which signals are inverted with respect to each other.

29. Means for driving a light modulating device as claimed in claim 17, wherein the state selection means includes a look-up table responsive to the first state and the second state for providing said intermediate state.

30. Means for driving a light modulating device as claimed in claim 29, wherein the look-up table is responsive only to a predetermined proportion of the possible transition between states.

31. Means for driving a light modulating device as claimed in claim 29, wherein the transmission level of said intermediate state is an average between the first transmission level of the first state and the second transmission level of the second state.

32. Means for driving a light modulating device as claimed in claim 17, wherein the addressable matrix of modulating elements comprises a ferroelectric liquid crystal display.

33. A method of driving a light modulating device comprising an addressable matrix of modulating elements, the method comprising selectively addressing each element in order to vary the transmission level of the element relative to the transmission levels of other elements, the addressing including spatial and/or temporal dither means for addressing separately addressable spatial bits of each element with different combinations of spatial dither signals and/or for addressing at least part of each element with different combinations of temporal dither signals applied to separately addressable temporal bits corresponding to subframes of different periods to produce a plurality of different transmission levels, and switching at least a part of each element between different states corresponding to different transmission levels by means of ON and OFF switching signals, wherein the state selection provides a transitional transmission level in response to a transition in transmission level between adjacent elements and/or successive frames, which transition involves changing the state of one of the bits between a first state corresponding to a first transmission level and a second state corresponding to a second transmission level, for providing at least one intermediate state corresponding to a transmission level which is intermediate the first transmission level and the second transmission level.

* * * * *

UNITED STATES PATENT AND TRADEMARK OFFICE

CERTIFICATE OF CORRECTION

PATENT NO. : 6,417,864 B1 
DATED : July 9, 2002
INVENTOR(S) : John Clifford Jones and Alistair Graham It is certified that error appears in the above-identified patent and that said Letters Patent is hereby corrected as shown below:

Title page,
Item [73], Assignee, add -- Sharp Kabushiki Kaisha, Osaka (JP) --

Signed and Sealed this

Ninth Day of March, 2004

JON W. DUDAS
*Acting Director of the United States Patent and Trademark Office*